US011745041B2

(12) United States Patent
Hill

(10) Patent No.: US 11,745,041 B2
(45) Date of Patent: Sep. 5, 2023

(54) EXERCISING ASSEMBLY

(71) Applicant: Marvin Hill, Columbus, OH (US)

(72) Inventor: Marvin Hill, Columbus, OH (US)

( * ) Notice: Subject to any disclaimer, the term of this patent is extended or adjusted under 35 U.S.C. 154(b) by 140 days.

(21) Appl. No.: 17/412,407

(22) Filed: Aug. 26, 2021

(65) Prior Publication Data

US 2023/0063124 A1 Mar. 2, 2023

(51) Int. Cl.

| | |
|---|---|
| ***A63B 21/04*** | (2006.01) |
| ***A63B 21/055*** | (2006.01) |
| ***A63B 21/00*** | (2006.01) |
| ***A63B 23/12*** | (2006.01) |
| ***A63B 23/04*** | (2006.01) |

(52) U.S. Cl.

CPC ..... *A63B 21/0428* (2013.01); *A63B 21/0557* (2013.01); *A63B 21/4034* (2015.10); *A63B 21/4035* (2015.10); *A63B 21/4045* (2015.10); *A63B 21/4047* (2015.10); *A63B 23/0494* (2013.01); *A63B 23/1254* (2013.01); *A63B 23/1281* (2013.01); *A63B 2208/0233* (2013.01)

(58) Field of Classification Search

CPC ..... A63B 21/00043; A63B 21/00058–00069; A63B 21/02; A63B 21/022–025; A63B 21/04–0407; A63B 21/0428; A63B 21/0442; A63B 21/055–0557; A63B 21/16–1609; A63B 21/4027–4035; A63B 21/4043; A63B 21/4045; A63B 22/0076–2022/0079; A63B 22/0087–0089; A63B 22/0048–2022/0074; A63B 23/0494; A63B 23/1254; A63B 23/1281; A63B 2208/0233

See application file for complete search history.

(56) References Cited

U.S. PATENT DOCUMENTS

| | | | | |
|---|---|---|---|---|
| 5,369,255 | A | 11/1994 | Sherer | |
| 5,387,171 | A * | 2/1995 | Casey | A63B 21/1609 482/133 |
| 6,872,170 | B2 * | 3/2005 | Kuo | A63B 21/154 482/130 |
| 8,405,010 | B2 | 3/2013 | Van Dyke | |
| D759,419 | S | 1/2016 | Ruscito | |
| 10,178,712 | B2 | 1/2019 | Fowkes | |
| 10,232,213 | B1 * | 3/2019 | Smith, Jr. | A63B 23/0405 |

(Continued)

*Primary Examiner* — Garrett K Atkinson
*Assistant Examiner* — Kathleen M Fisk

(57) ABSTRACT

An exercising assembly for fitness training and rehabilitation includes a first base, which is positionable on a substantially horizontal surface. An engagement module is selectively engageable to the first base so that the engagement module is positioned proximate to a first end of the first base. A plurality of attachment elements is engaged to the first base, the engagement module, and to a plurality of tensioners. The attachment elements are selectively mutually couplable. A plurality of first interface elements is selectively engageable to the engagement module. Respective attachment elements of the plurality of attachment elements are engaged to each of the first interface elements. Respective tensioners thus are extendable between a respective first interface element and one or more of the first base and the engagement module. The respective tensioners provide resistance to the user moving the first interface elements.

19 Claims, 20 Drawing Sheets

(56) References Cited

U.S. PATENT DOCUMENTS

| | | | | |
|---|---|---|---|---|
| 2001/0045430 | A1 | 11/2001 | Mawood | |
| 2008/0217327 | A1 | 9/2008 | Herrera | |
| 2009/0118106 | A1* | 5/2009 | Leisenring | A63B 21/4035 482/121 |
| 2014/0141948 | A1* | 5/2014 | Aronson | A63B 22/0087 482/128 |

* cited by examiner

EXERCISING ASSEMBLY

(c) STATEMENT REGARDING FEDERALLY SPONSORED RESEARCH OR DEVELOPMENT

Not Applicable

(b) CROSS-REFERENCE TO RELATED APPLICATIONS

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to exercising assemblies and more particularly pertains to a new exercising assembly for fitness training and rehabilitation. The present invention discloses an exercise assembly comprising a portable base to which can be selectively attached an engagement module and a step module. Multiple attachment are selectively engageable to the engagement module and to a chair. Tensioners are engageable to the attachments and one or more of the base, the chair, and the engagement module. The exercise assembly enables performance of both upper and lower body exercises while standing and sitting.

(2) Description of Related Art Including Information Disclosed Under 37 CFR 1.97 and 1.98

The prior art relates to exercising assemblies. Prior art exercise assemblies generally comprise a base and tensioners, such as elastic bands, and allow for a limited range of exercises. Generally, prior art exercise assemblies do not allow for both seated and standing exercises. What is lacking in the prior art is an exercise assembly comprising a portable base to which can be selectively attached an engagement module and a step module. Multiple attachments are selectively engageable to the engagement module and to a chair. Tensioners are engageable to the attachments and one or more of the base, the chair, and the engagement module. The exercise assembly enables performance of both upper and lower body exercises while standing and sitting.

(h) BRIEF SUMMARY OF THE INVENTION

An embodiment of the disclosure meets the needs presented above by generally comprising a first base, which is configured to be positioned on a substantially horizontal surface. An engagement module is selectively engageable to the first base so that the engagement module is positioned proximate to a first end of the first base. A plurality of attachment elements is engaged to the first base, the engagement module, and to a plurality of tensioners. The attachment elements are selectively mutually couplable. A plurality of first interface elements is selectively engageable to the engagement module. Respective attachment elements of the plurality of attachment elements are engaged to each of the first interface elements. Respective tensioners thus are extendable between a respective first interface element and one or more of the first base and the engagement module. The respective tensioners are configured to provide resistance to a user moving the first interface elements.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
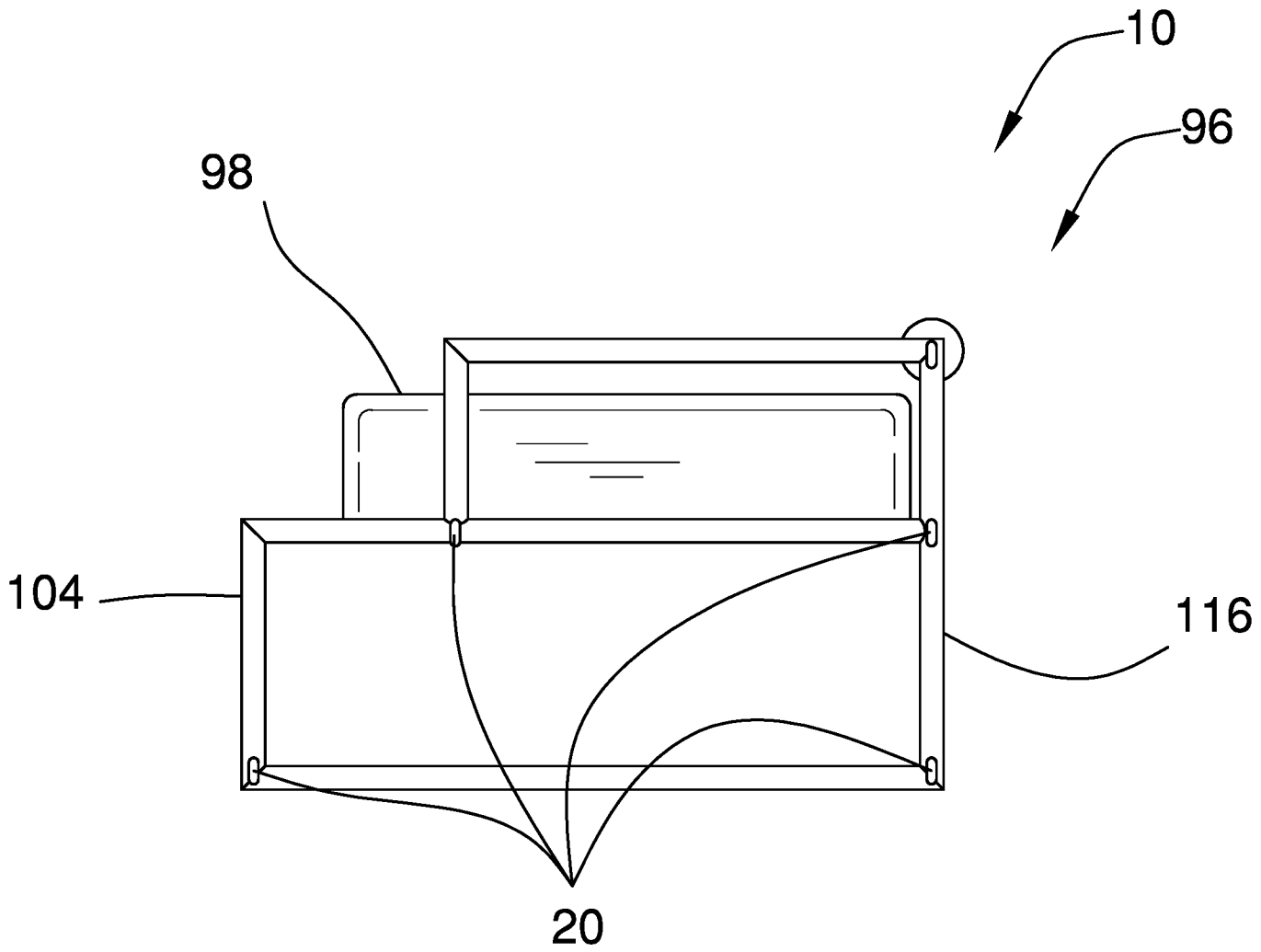
FIG. 1 is a side view of an exercising assembly according to an embodiment of the disclosure.
Figure 2:
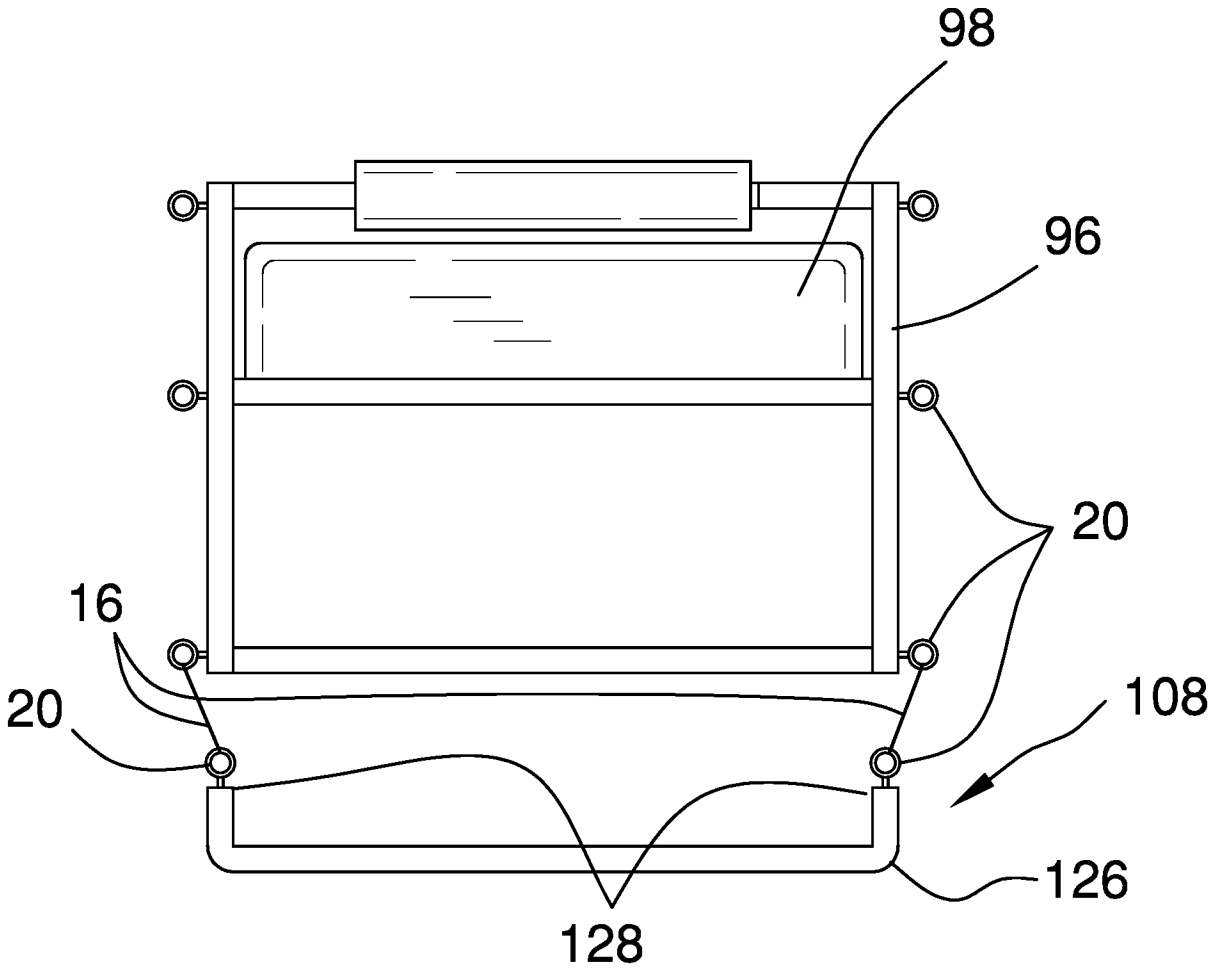
FIG. 2 is a front view of an embodiment of the disclosure.
Figure 3:
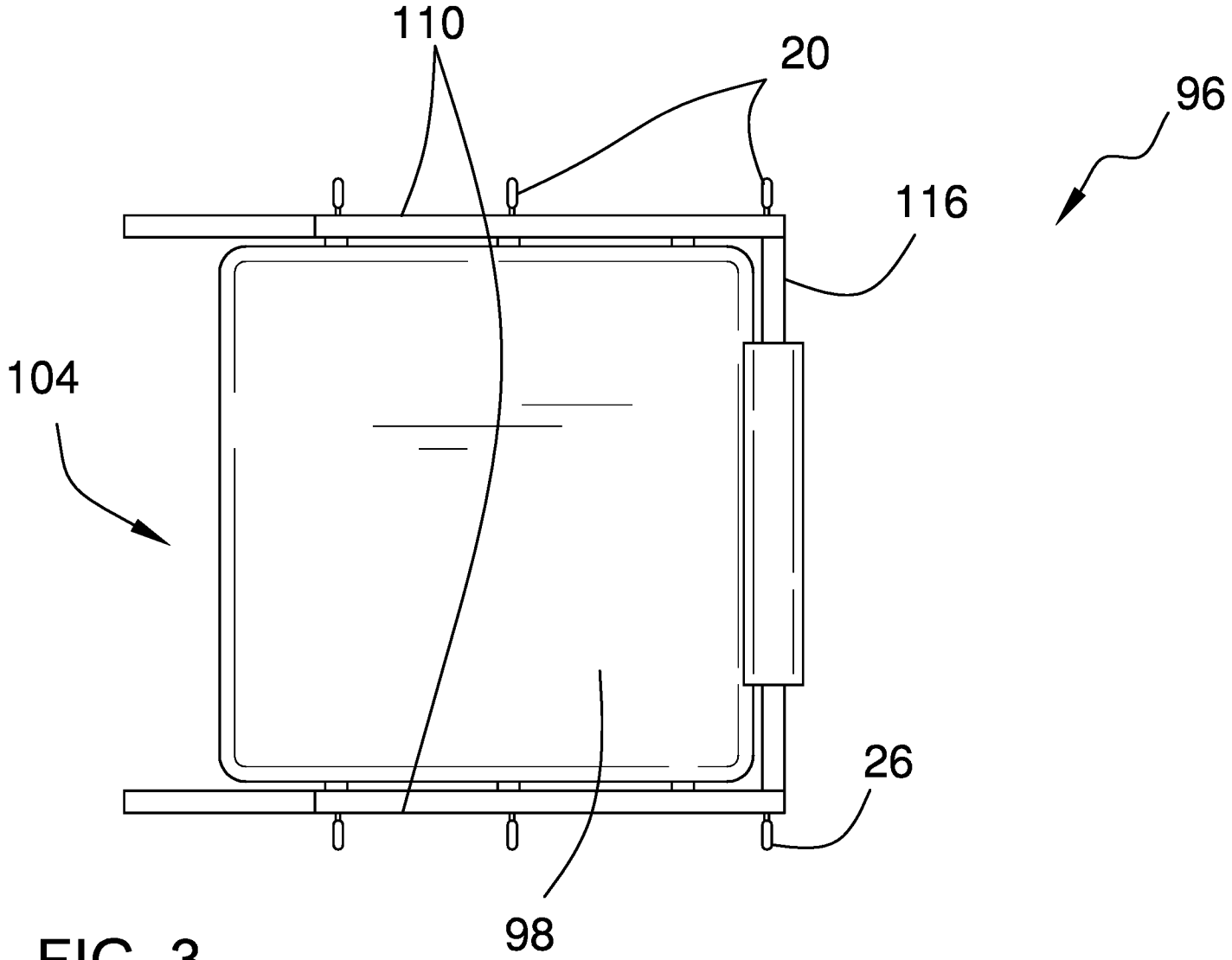
FIG. 3 is a top view of an embodiment of the disclosure.
Figure 4:
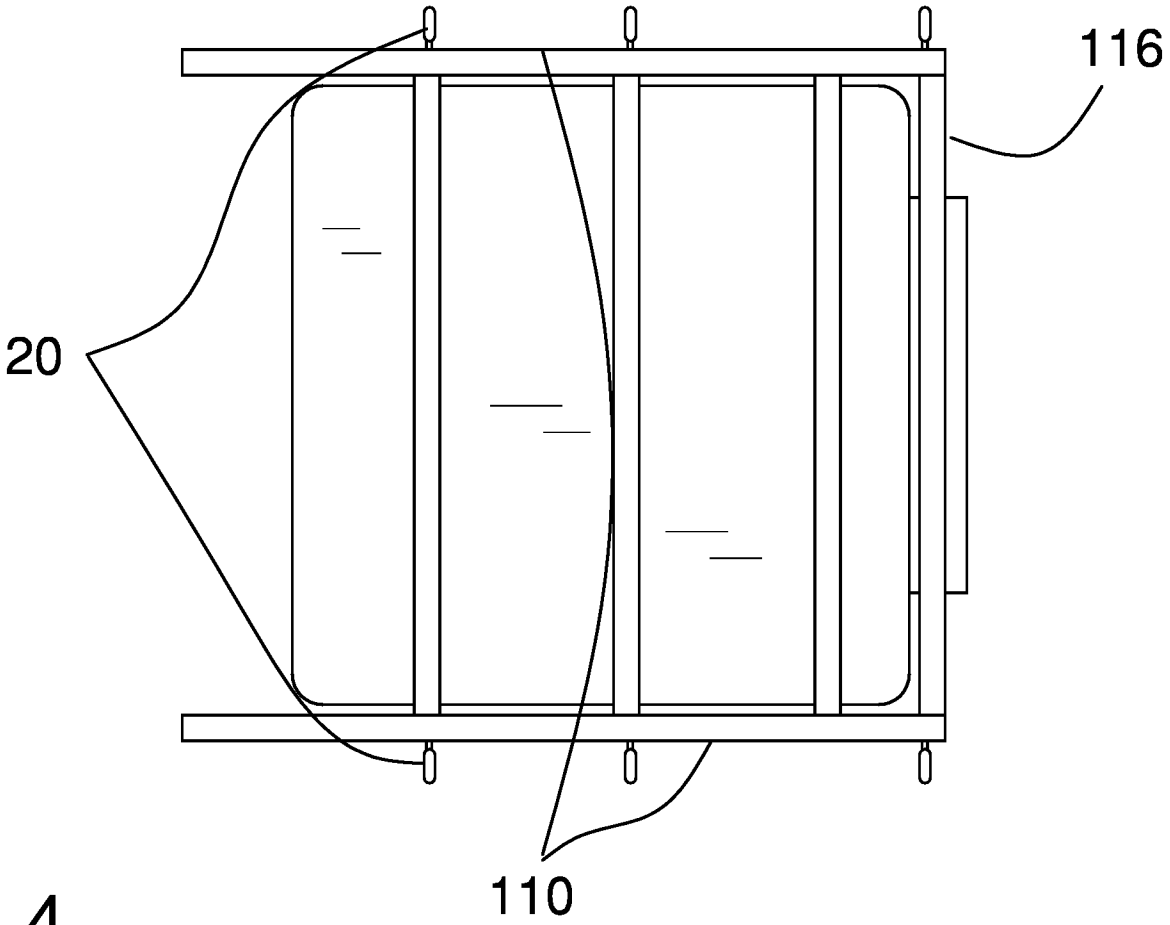
FIG. 4 is a bottom view of an embodiment of the disclosure.
Figure 6:
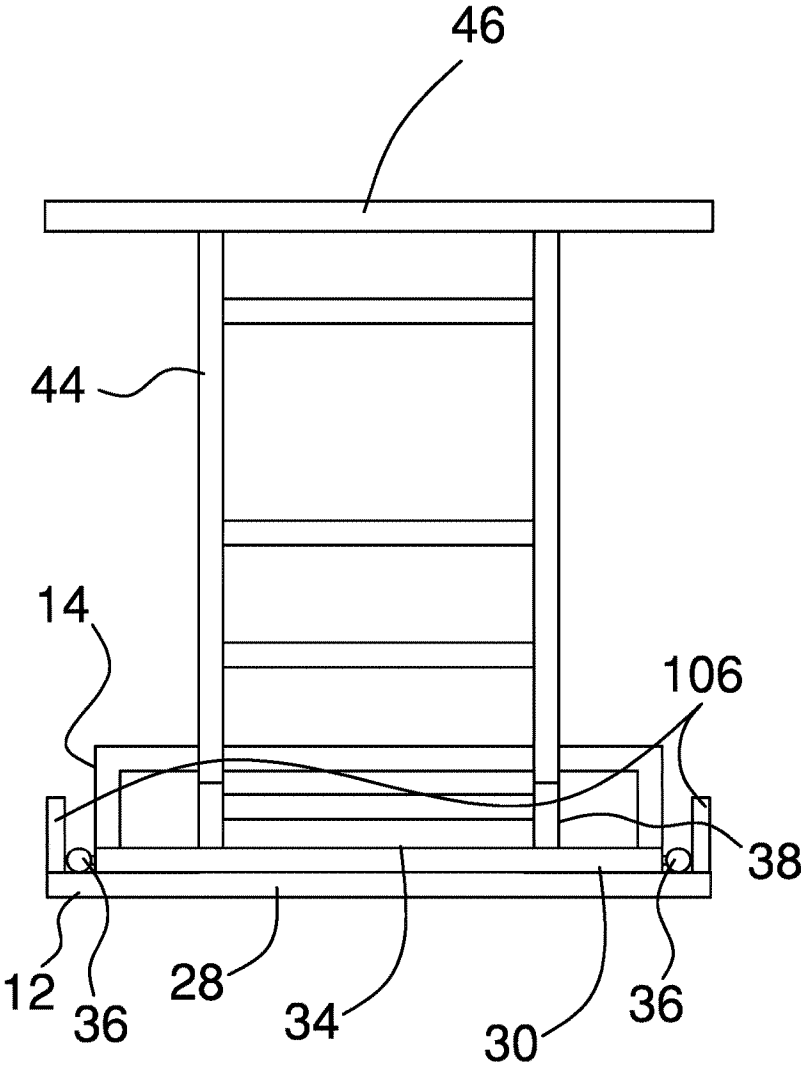
FIG. 6 is a rear view of an embodiment of the disclosure.
Figure 5:
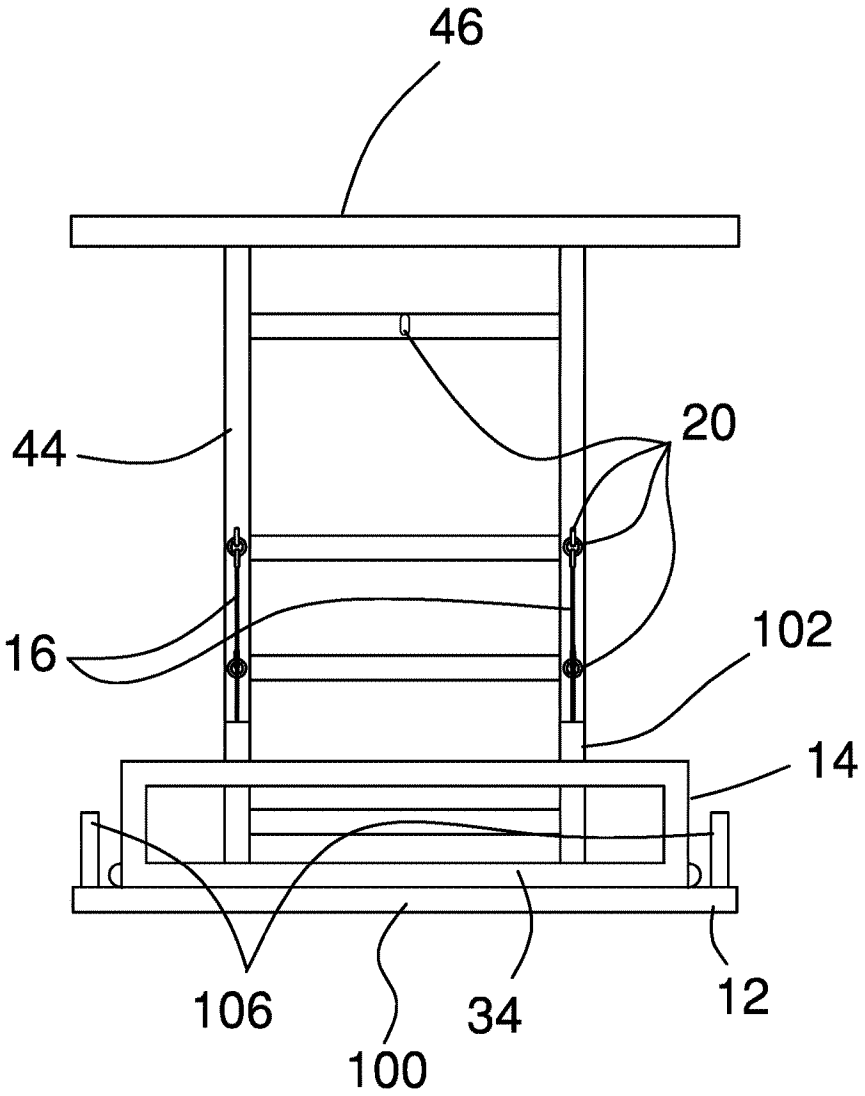
FIG. 5 is a front view of an embodiment of the disclosure.
Figure 7:
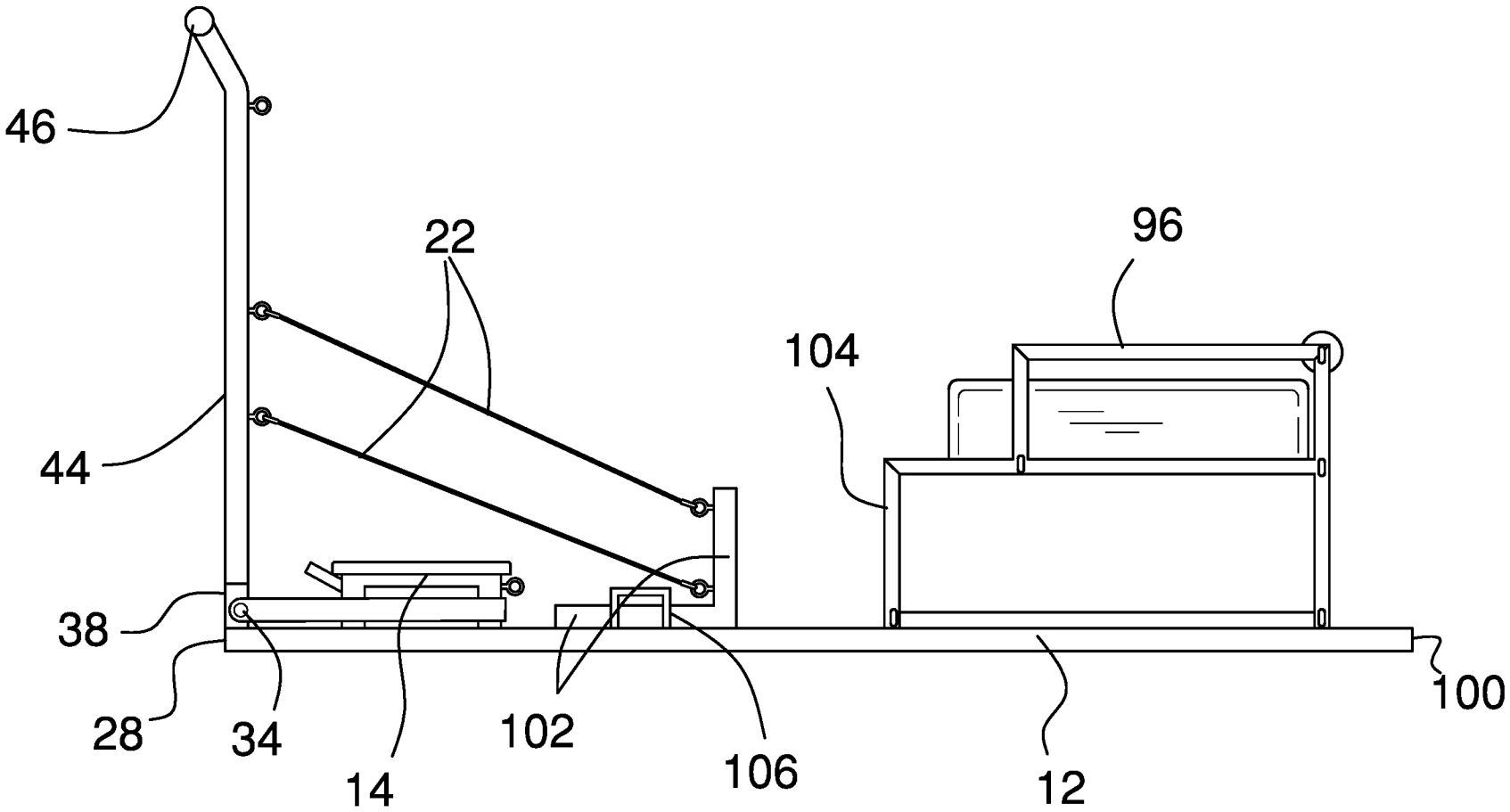
FIG. 7 is a side view of an embodiment of the disclosure.
Figure 8:
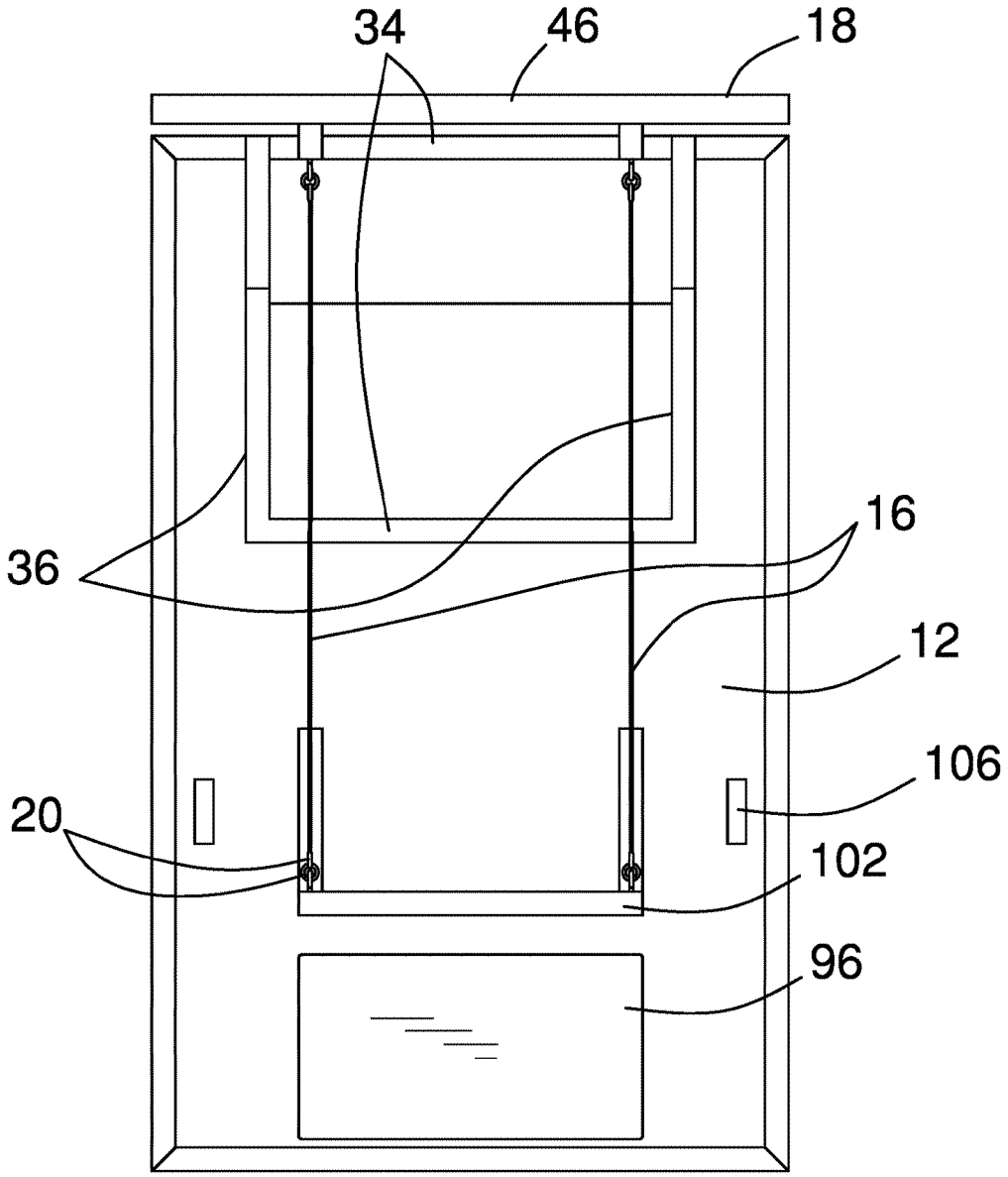
FIG. 8 is a top view of an embodiment of the disclosure.
Figure 9:
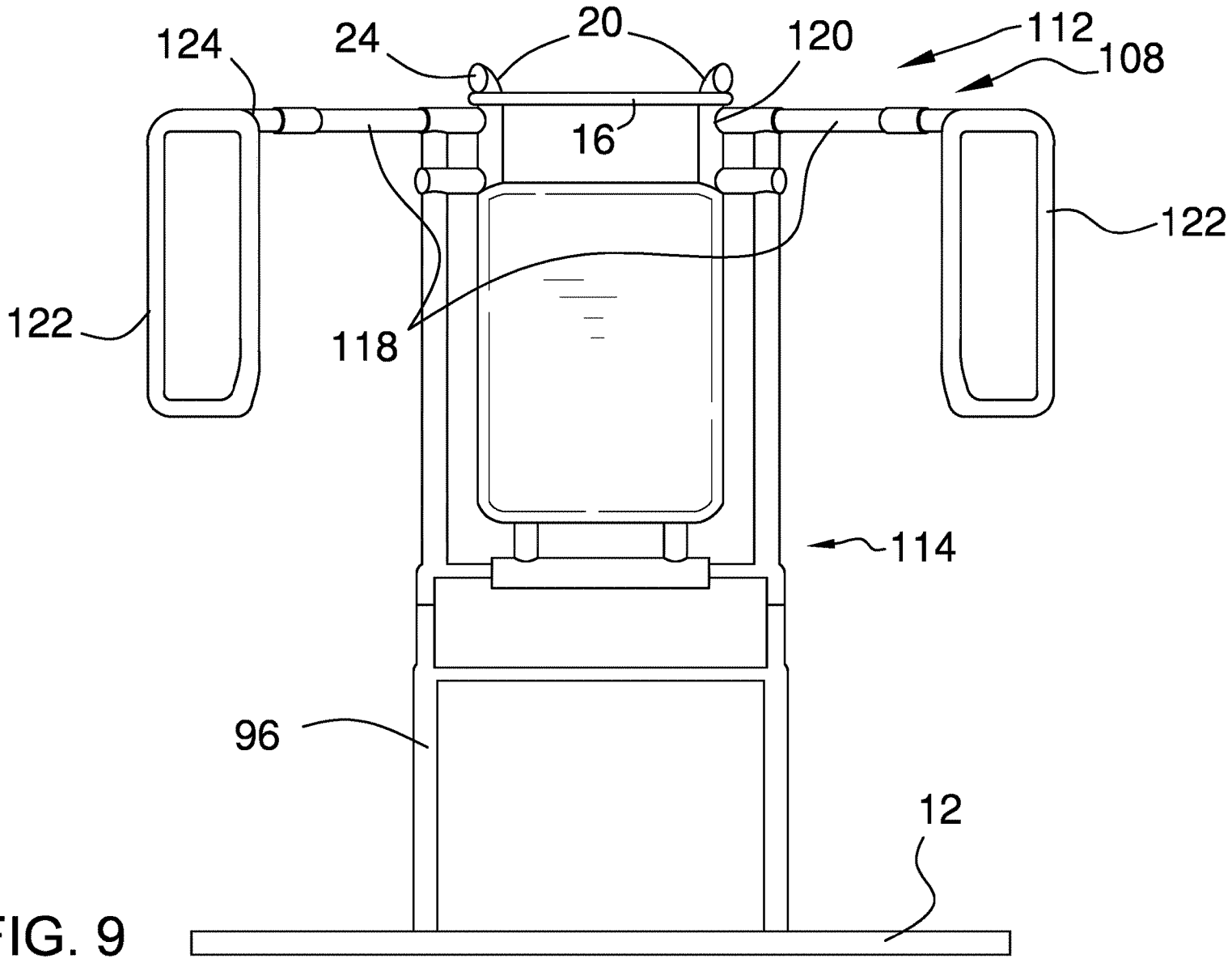
FIG. 9 is a front view of an embodiment of the disclosure.
Figure 10:
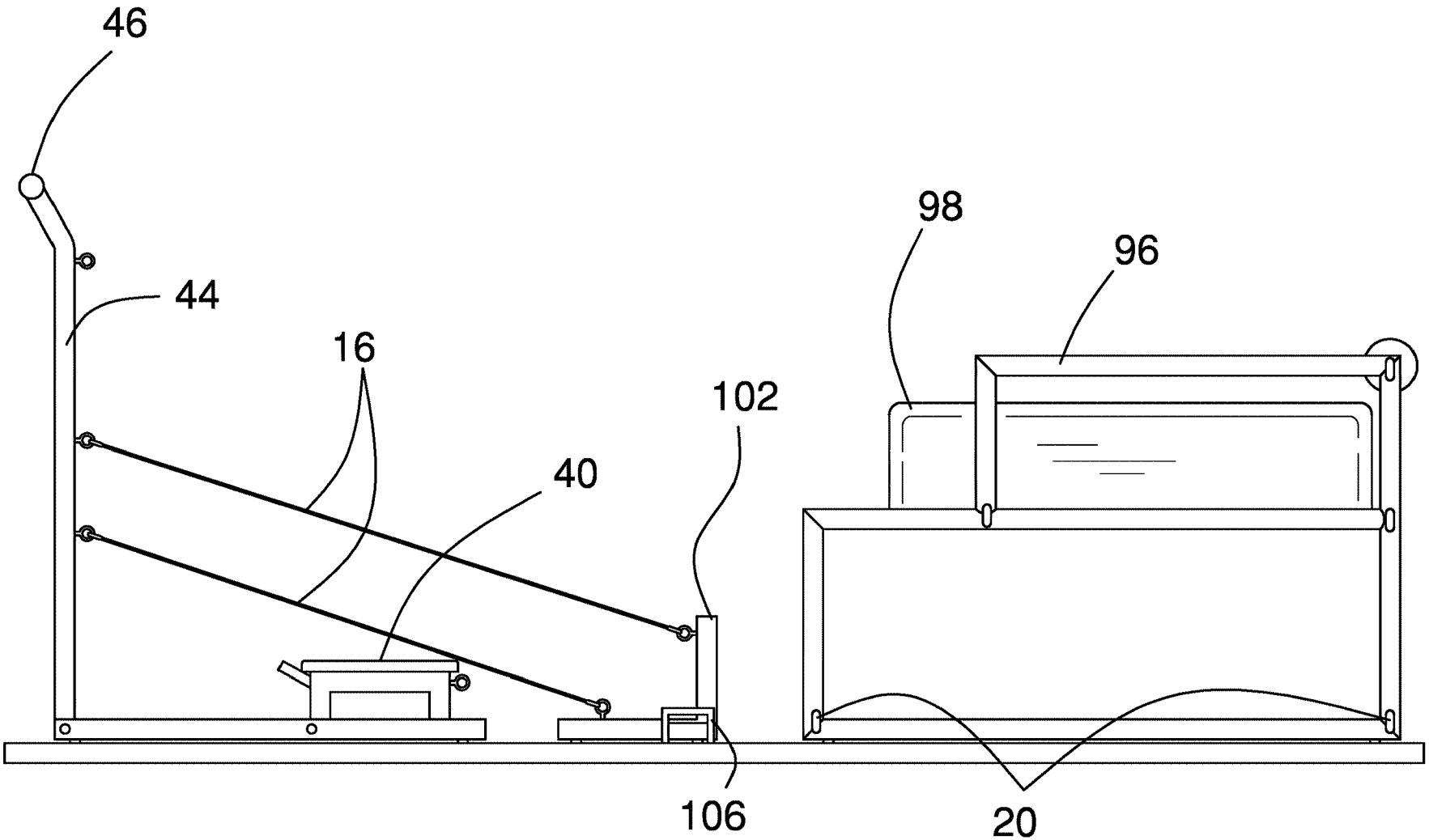
FIG. 10 is an in-use view of an embodiment of the disclosure.
Figure 11:
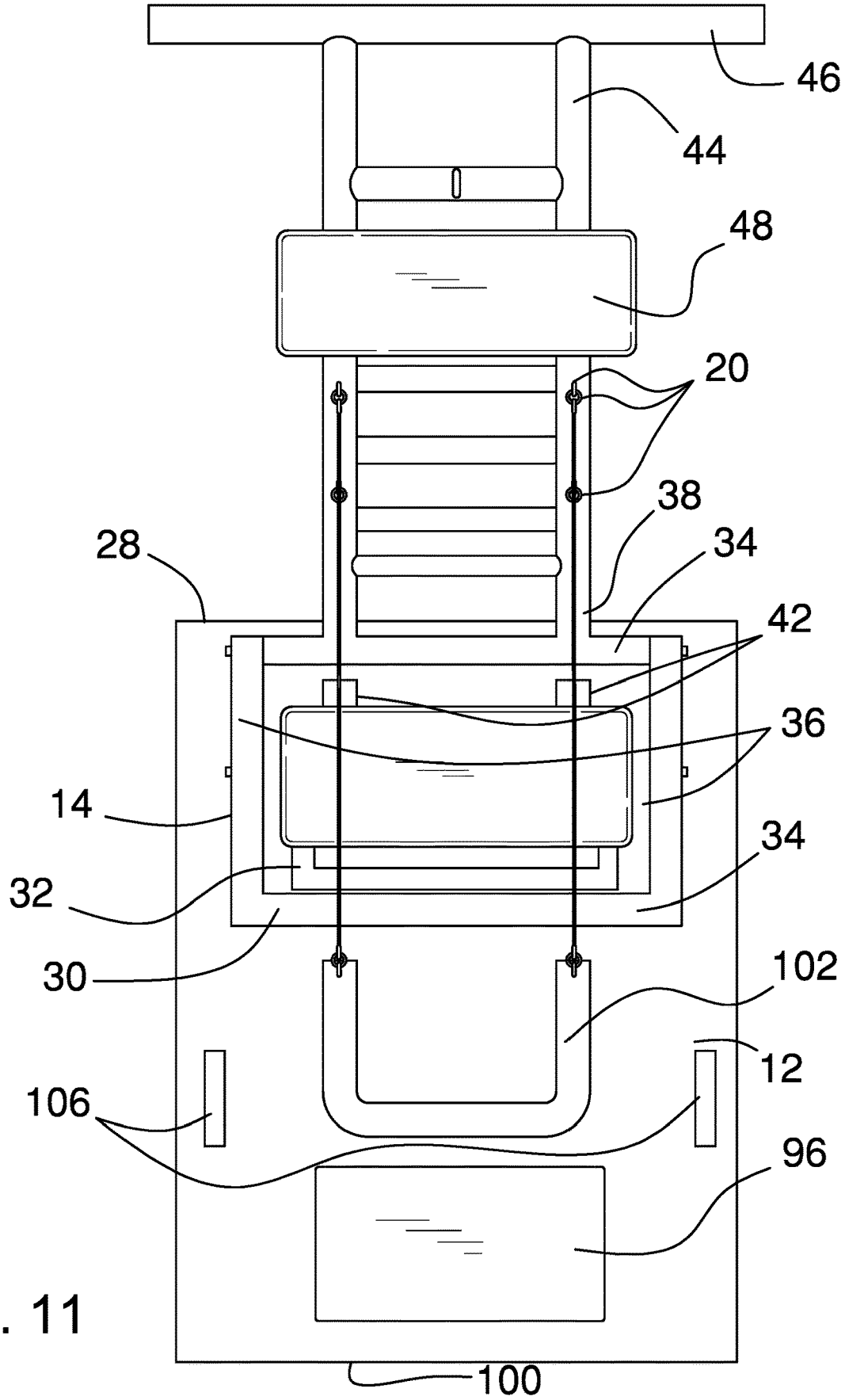
FIG. 11 is a top view of an embodiment of the disclosure.
Figure 12:
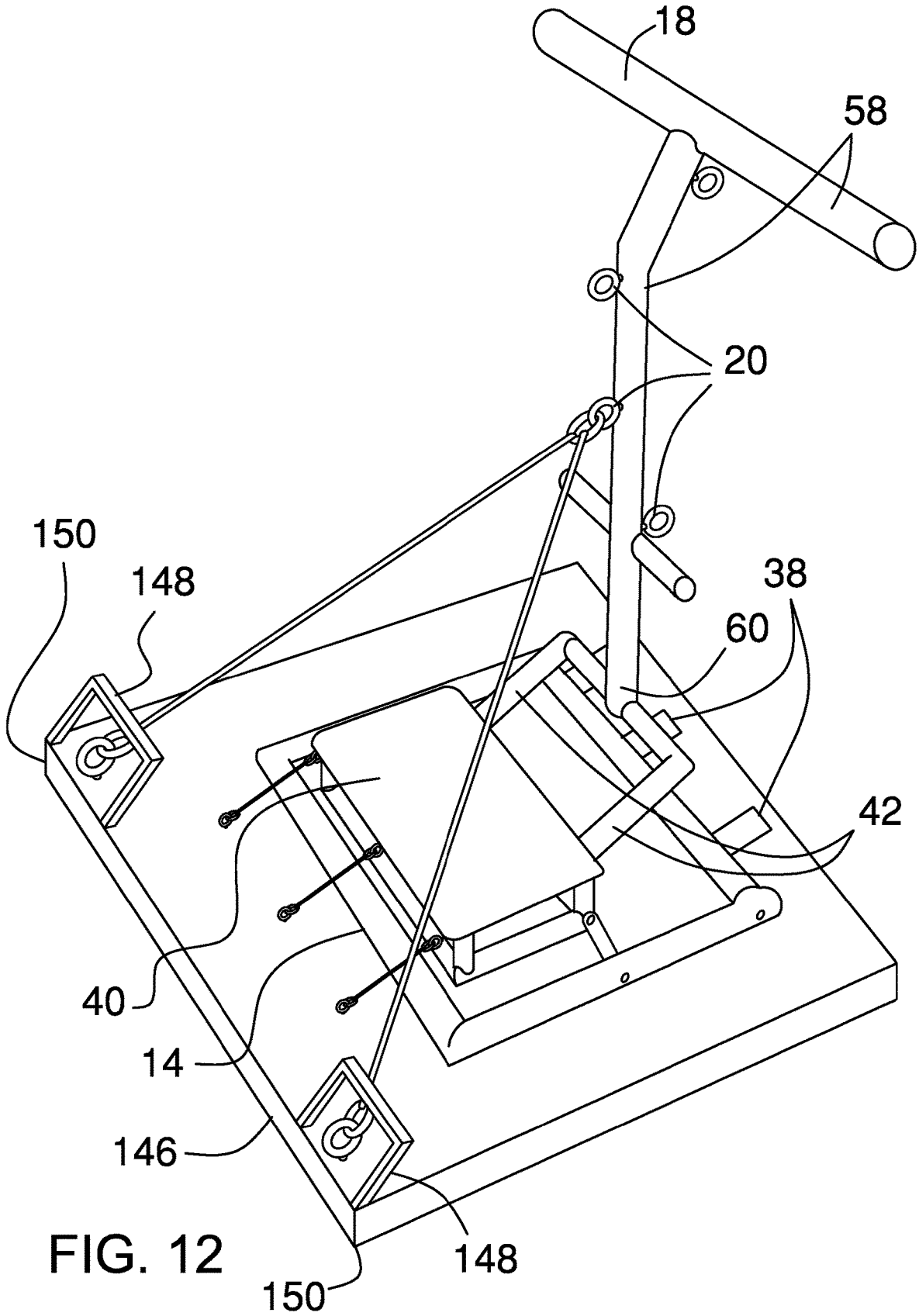
FIG. 12 is an isometric perspective view of an embodiment of the disclosure.
Figure 13:
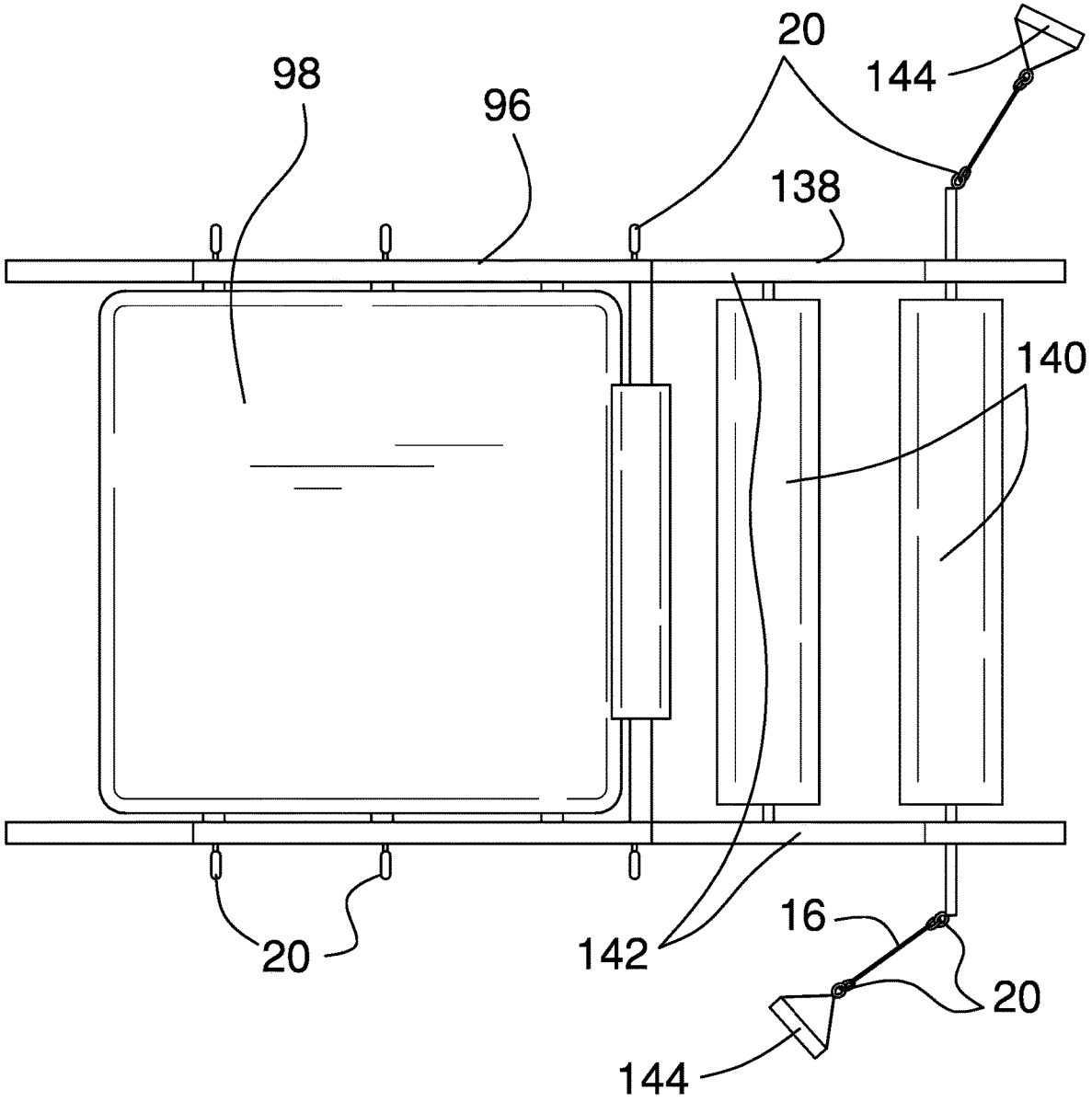
FIG. 13 is a top view of an embodiment of the disclosure.
Figure 14:
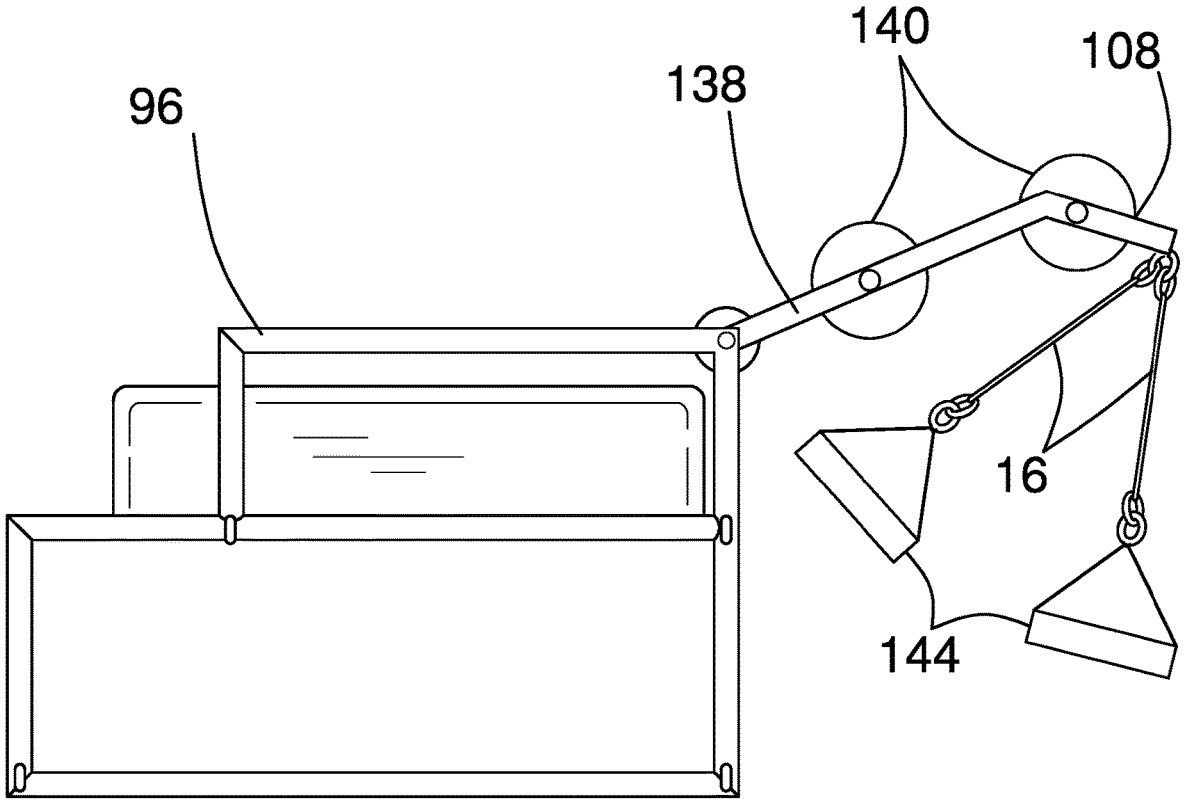
FIG. 14 is a side view of an embodiment of the disclosure.
Figure 15:
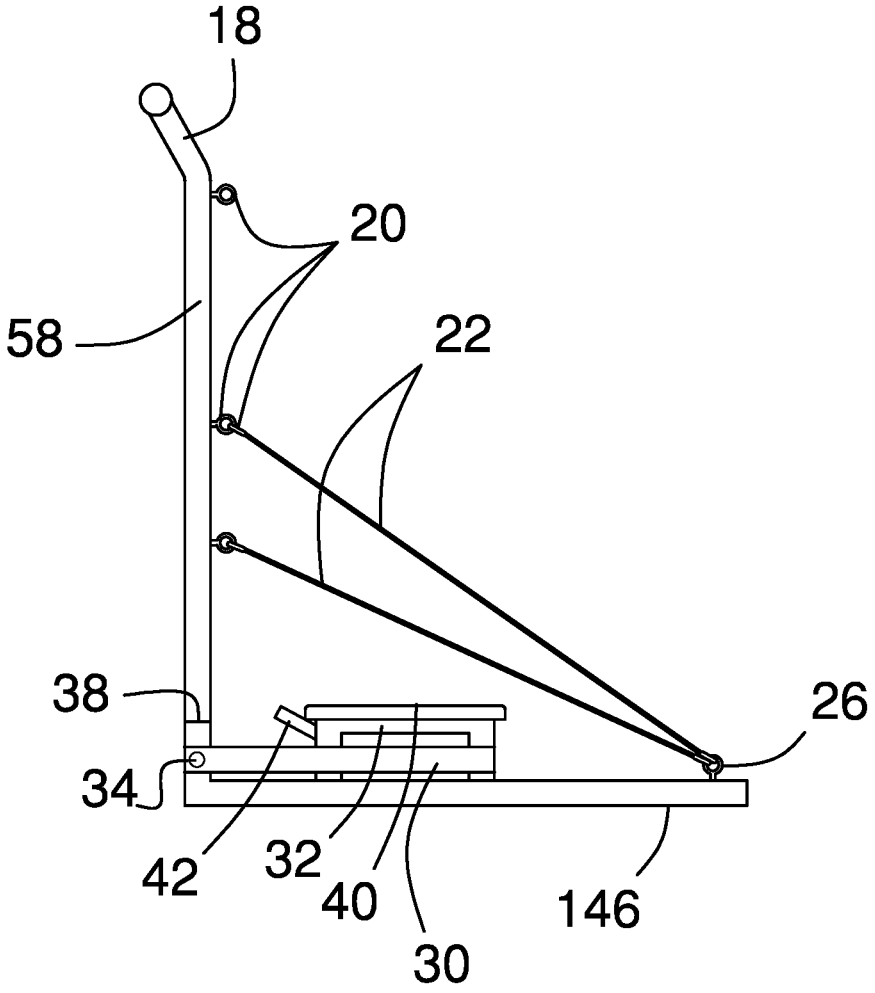
FIG. 15 is a side view of an embodiment of the disclosure.
Figure 16:
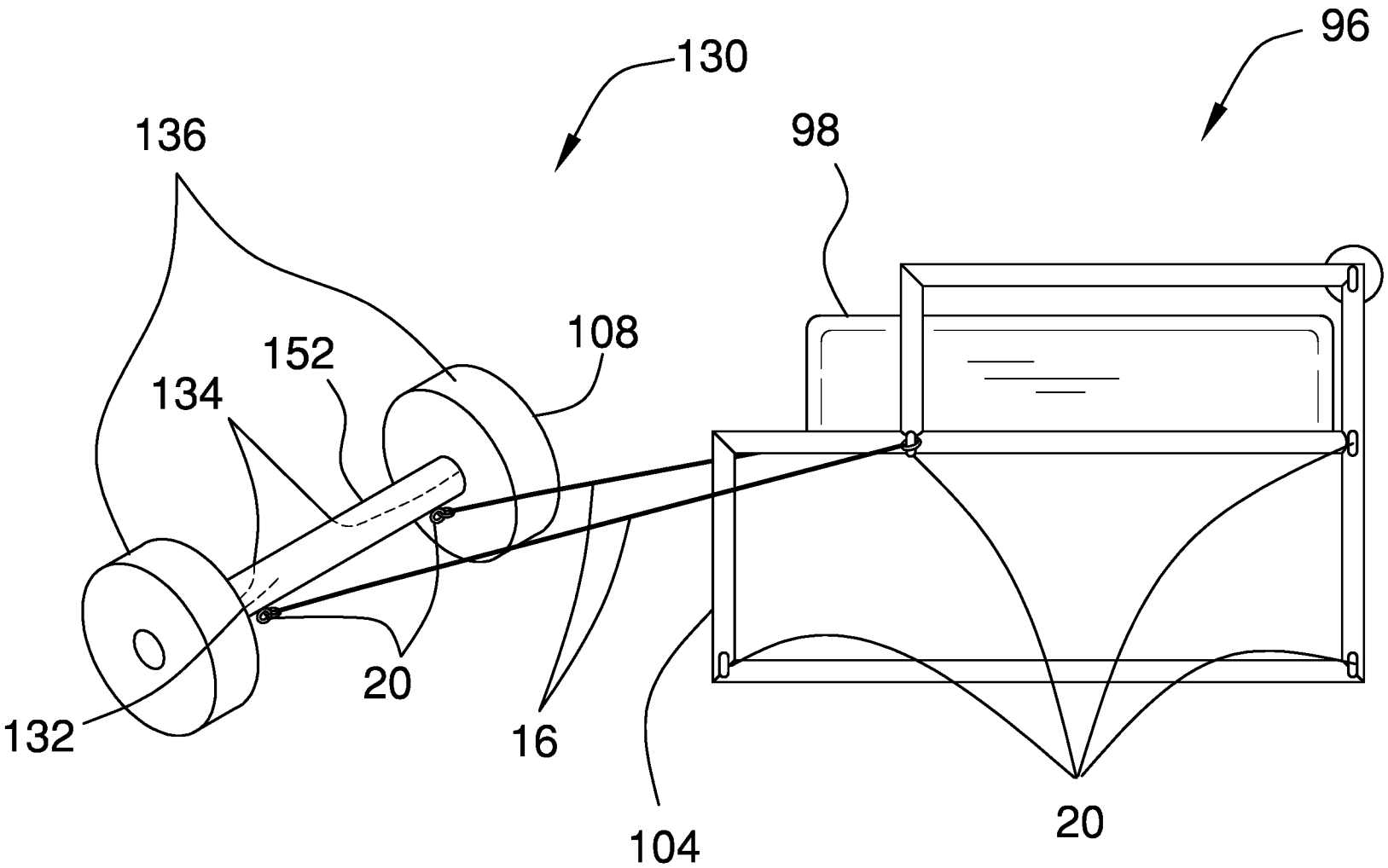
FIG. 16 is an in-use view of an embodiment of the disclosure.
Figure 17:
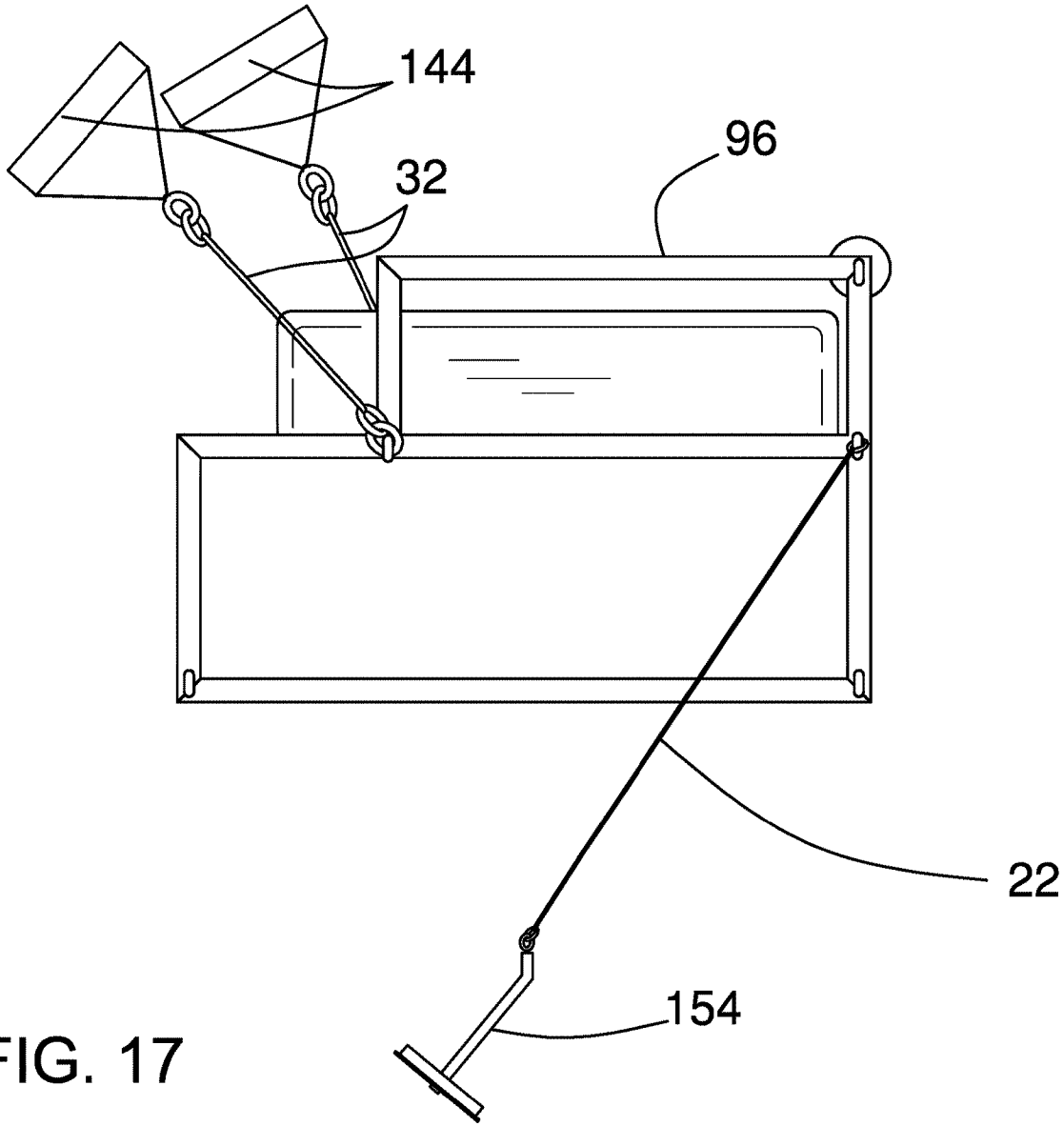
FIG. 17 is an in-use view of an embodiment of the disclosure.

With reference now to the drawings, and in particular to FIGS. 1 through 24 thereof, a new exercising assembly embodying the principles and concepts of an embodiment of the disclosure and generally designated by the reference numeral 10 will be described.

As best illustrated in FIGS. 1 through 24, the exercising assembly 10 generally comprises a first base 12, an engagement module 14, a plurality of tensioners 16, a plurality of first interface elements 18, and a plurality of attachment elements 20. The first base 12 is configured to be positioned on a substantially horizontal surface. The tensioners 16 comprise may comprise elastic bands 22, springs, and the like. The attachment elements 20 comprise one or more of hooks 24, eyebolts 26, rings, carabiniers, clips, and the like.

The engagement module 14 is selectively engageable to the first base 12 so that the engagement module 14 is positioned proximate to a first end 28 of the first base 12. The plurality of attachment elements 20 is engaged to the first base 12, the engagement module 14, the tensioners 16, and the first interface elements 18. The attachment elements 20 are selectively mutually couplable.

The plurality of first interface elements 18 is selectively engageable to the engagement module 14. Respective tensioners 16 are extendable between a respective first interface element 18 and one or more of the first base 12 and the engagement module 14. The respective tensioners 16 are configured to provide resistance to the user moving the first interface elements 18.

Figure 22:
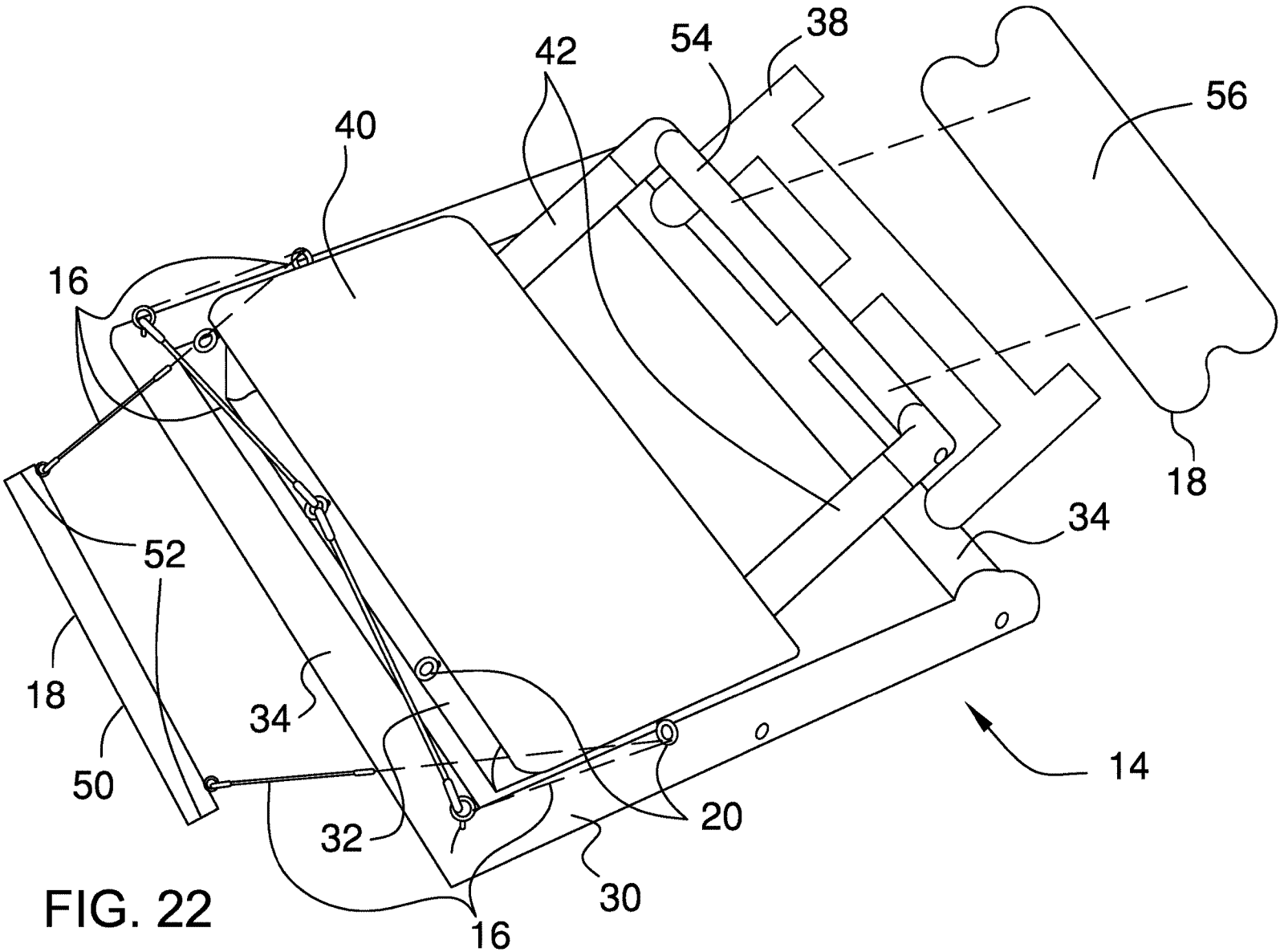
FIG. 22 is an isometric perspective view of an embodiment of the disclosure.

The engagement module 14 comprises a lower frame 30 and an upper frame 32, as shown in FIG. 22. The upper frame 32 is hingedly engaged to the lower frame 30. A respective one of a pair of end members 34 of the lower frame 30 is positioned proximate to the first end 28 of the first base 12 and is rotationally engaged to and extends between a pair of side members 36 of the lower frame 30. A first connector 38 is engaged to the respective one of the pair of end members 34. A footpad 40 is engaged to the upper frame 32. A second connector 42 is engaged to the upper frame 32 distal from the lower frame 30 and extends toward the first end 28 of the first base 12. Respective tensioners 16 are engaged to and extend between the lower frame 30 and the upper frame 32. The footpad 40 is configured for positioning of one or both feet of a user, positioning the user to perform a foot exercise or an ankle exercise.

The plurality of first interface elements 18 comprises a press frame 44, which is selectively engageable to the first connector 38. A press handle 46 is engaged to the press frame 44 distal from the first base 12. Respective attachment elements 20 of the plurality of attachment elements 20 are engaged to the press frame 44. The press frame 44 is selectively engageable to the first base 12 by engagement of a respective tensioner 16 between a respective attachment element 20 positioned on the press frame 44 and a respective attachment element 20 positioned on the first base 12. The press handle 46 is configured to be grasped in one or both hands of the user, positioning the user to selectively perform a press exercise and a rowing exercise.

A press plate 48 is selectively engageable to the press frame 44 and is configured for positioning one or both of the feet of the user, positioning the user to perform a leg press exercise.

The plurality of first interface elements 18 also may comprises a foot rod 50, which has opposing termini 52. A pair of attachment elements 20 is engaged to the foot rod 50. The attachment elements 20 are positioned singly proximate to the opposing termini 52. The attachment elements 20 are selectively engageable to the respective tensioners 16 which extend between the lower frame 30 and the upper frame 32. The foot rod 50 is configured to be positioned atop one or both of the feet of the user when the one or both of the feet are positioned on the footpad 40. The user thus is positioned to perform foot and ankle exercises.

An arch rod 54 is selectively and rotationally engageable to the second connector 42. The arch rod 54 is configured to rollably engage an arch of a foot of the user, thus providing a massage to the foot. A heel plate 56 is selectively engageable to the arch rod 54 and is configured for positioning of one or both of the feet of the user, positioning the user to perform foot, ankle, and leg exercises.

The plurality of first interface elements 18 also may comprise a handle 58, which is selectively engageable to the first connector 38. Respective attachment elements 20 of the plurality of attachment elements 20 are engaged to the handle 58. The handle 58 is selectively engageable to the first base 12 by engagement of a respective tensioner 16 between a respective attachment element 20 positioned on the handle 58 and a respective attachment element 20 positioned on the first base 12. The handle 58 is configured to be grasped in one or both hands of the user, positioning the user to selectively perform a pressing exercise and a rowing exercise.

The plurality of first interface elements 18 also may comprise an adapter 60, which is selectively engageable to the second connector 42 so that the adapter 60 is positioned for axial rotation. The handle 58 is selectively engageable to the adapter 60. The handle 58 is configured to be grasped in one or both hands of the user, positioning the user to perform a pulldown exercise.

Figure 20:
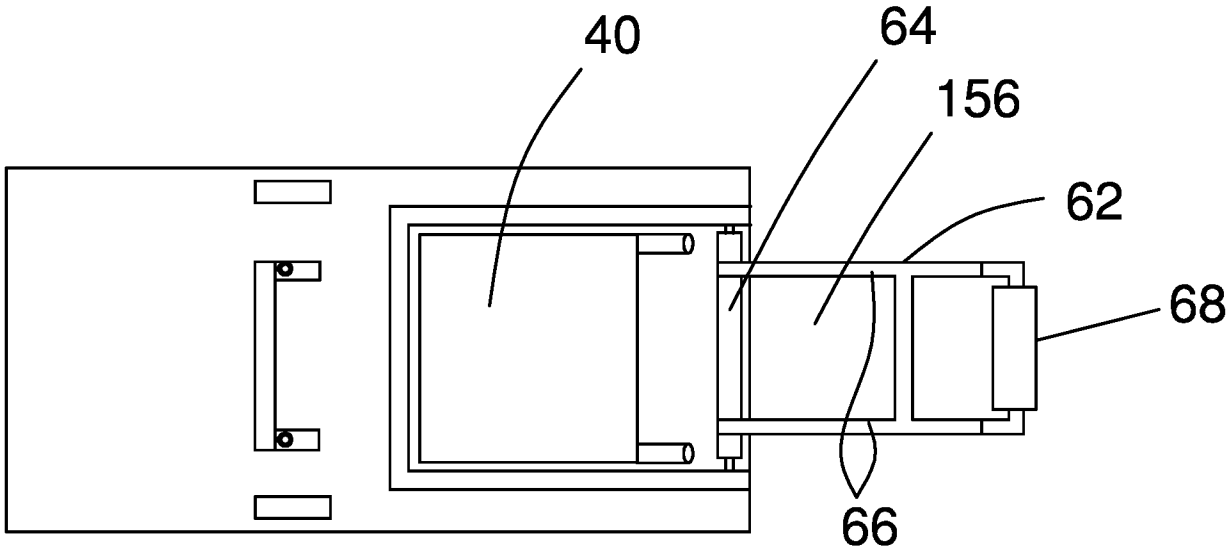
FIG. 20 is a top view of an embodiment of the disclosure.
Figure 21:
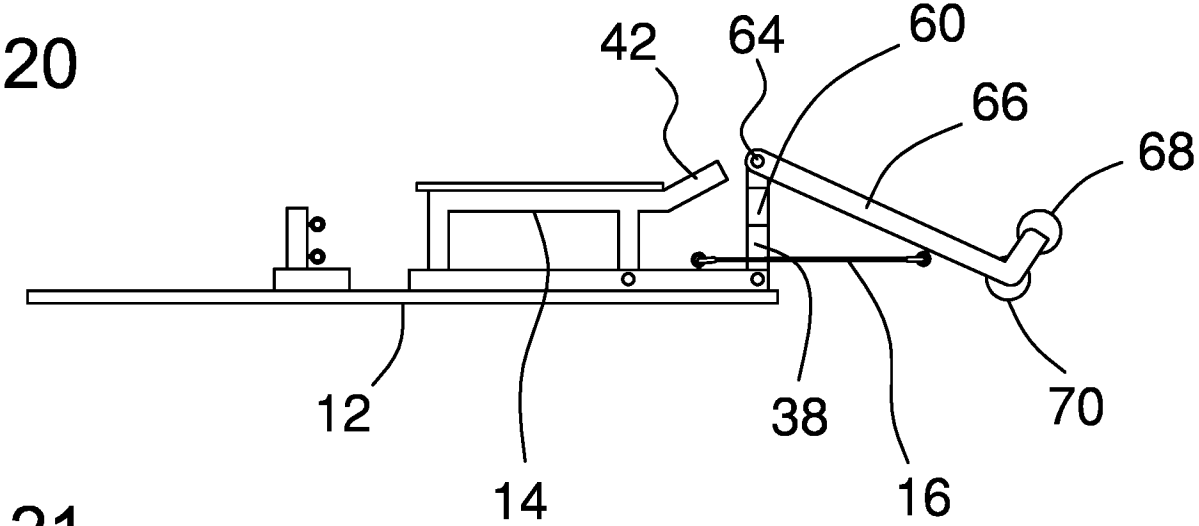
FIG. 21 is a side view of an embodiment of the disclosure.

The plurality of first interface elements 18 also may comprise a lift frame 62, which is selectively hingedly engageable by a forward element 64 to the adapter 60. Each of a pair of attachment elements 20 is engaged to a respective opposed side element 66 of lift frame 62. The attachment element 20 is positioned substantially equally distant from the forward element 64 and a rearward element 68 of the lift frame 62. The rearward element 68 is offset from a plane that is defined by the forward element 64 and the opposed side elements 66. The rearward element 68 may be padded, as shown in FIG. 20. The rearward element 68 is configured to engage one or both of the feet of the user, positioning the user to perform a leg lift exercise.

A pair of rollers 70 is engaged to the lift frame 62 and is positioned singly on the opposed side elements 66 proximate to the rearward element 68. One or both of the feet of the user are positionable within the lift frame 62, with one or both heels of the user engaging the rearward element 68. The user thus is positioned to perform a leg pull exercise.

Figure 18:
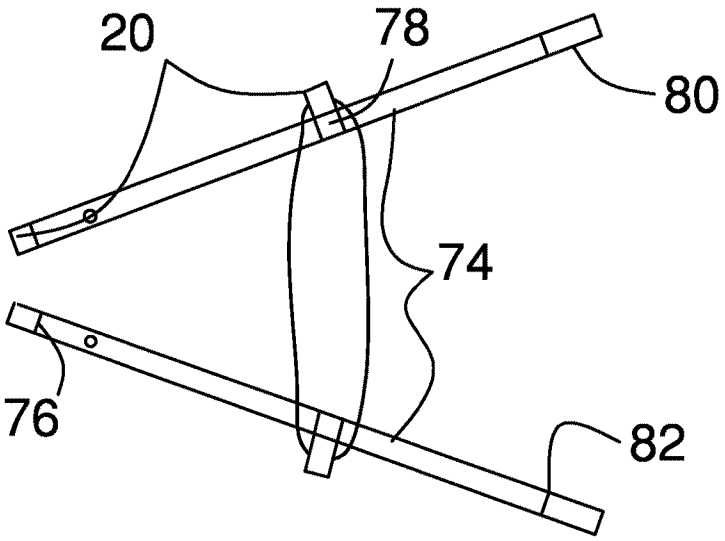
FIG. 18 is a top view of an embodiment of the disclosure.

The adapter 60 also is selectively engageable to the second connector 42 so that the second connector 42 is operationally engaged to the first connector 38. An extension 72 is selectively engageable to the adapter 60. The plurality of first interface elements 18 also may comprise a pair of swinging arms 74, which is selectively rotationally engageable to the extension 72 so that the extension 72 is positioned proximate to a first terminus 76 of each swinging arm 74. Respective attachment elements 20 are positioned two apiece on each swinging arm 74. As shown in FIG. 18, one attachment element 20 is positioned proximate to the first terminus 76 of the swinging arm 74 and, the other attachment element 20 is positioned proximate to a midpoint 78 of the swinging arm 74. The attachment elements 20 are opposingly positioned on the swinging arm 74 relative to the extension 72.

A thigh rest 80 is engaged to a second terminus 82 of the swinging arm 74. A respective tensioner 16 is selectively engageable to either the attachment elements 20 positioned proximate to the first termini 76 or to the attachment elements 20 positioned proximate to the midpoints 78. Each thigh rest 80 is configured for positioning of a respective thigh or for grasping in a respective hand of the user so that the user is positioned to perform a leg strengthening exercise and arm strengthening exercise, respectively.

Figure 23:
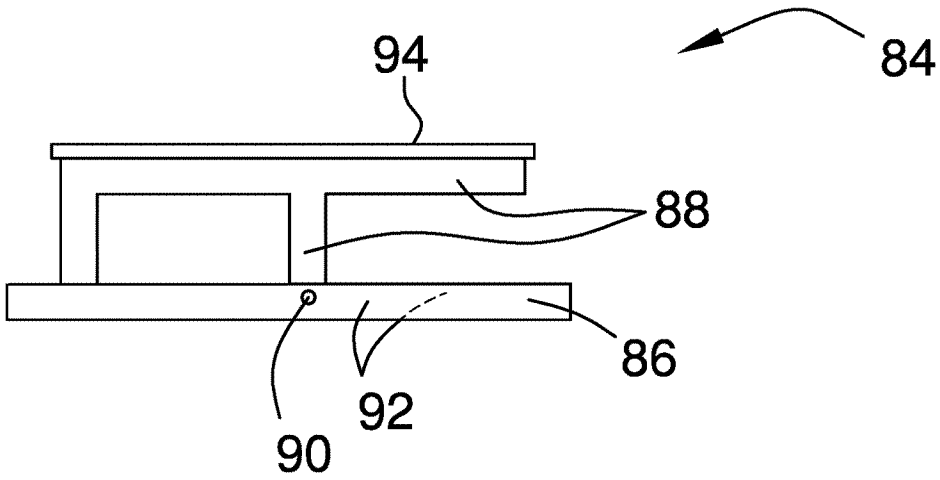
FIG. 23 is a side view of an embodiment of the disclosure.
Figure 24:
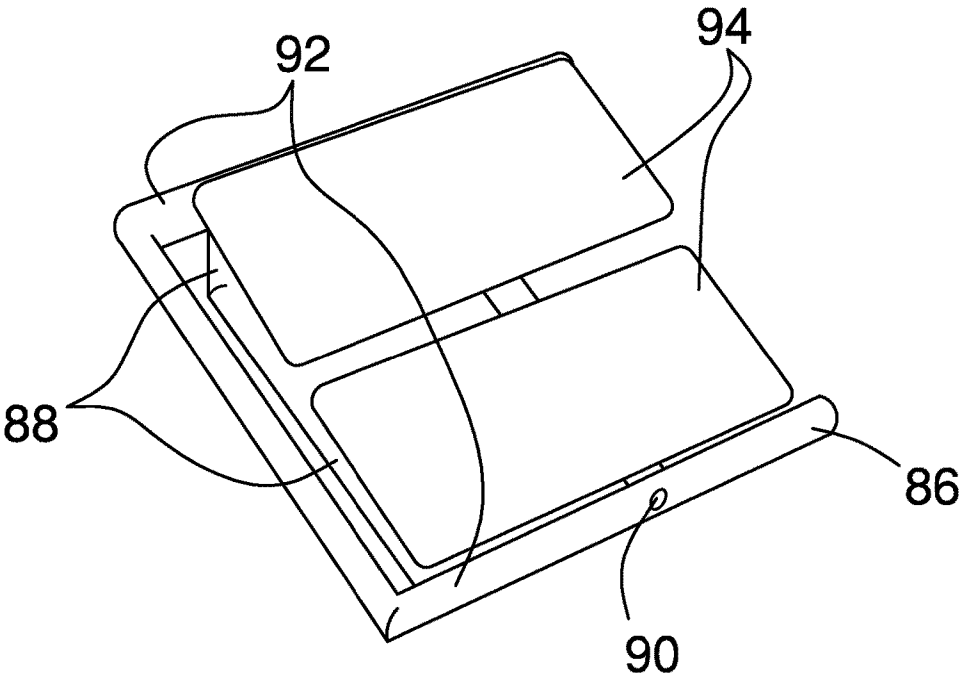
FIG. 24 is an isometric perspective view of an embodiment of the disclosure.

The exercise assembly 10 also may comprise a step module 84, as shown in FIGS. 23 and 24. The step module 84 comprises a lower framework 86 and a pair of foot frameworks 88. The lower framework 86 is selectively engageable to the first base 12. An axle 90 is engaged to and extends between opposed edges 92 of the lower framework 86. Each foot framework 88 is engaged to the axle 90. Respective attachment elements 20 of the plurality of attachment elements 20 are engaged to each of the foot frameworks 88. Each foot framework 88 is selectively engageable to the first base 12 by engagement of a respective tensioner 16 between the attachment element 20 positioned on the foot framework 88 and a respective attachment element 20 positioned on the first base 12. Each of a pair of foot plates 94 is engaged to a respective foot framework 88. Each foot plate 94 is configured for positioning of a respective foot of the user, positioning the user is positioned to perform a stepping exercise.

The exercise assembly 10 also may comprise a chair 96, as shown in FIGS. 1-4, which is configured to seat the user. The user is positioned to perform a variety of seated exercises using the step module 84 and respective tensioners 16 or using the engagement module 14 in combination with respective first interface elements 18 and respective tensioners 16. A cushion 98 is selectively positionable on the chair 96. The chair 96 is selectively engageable to the first base 12 so that the chair 96 is positioned proximate to a second end 100 of the first base 12 and faces the first end.

Figure 19:
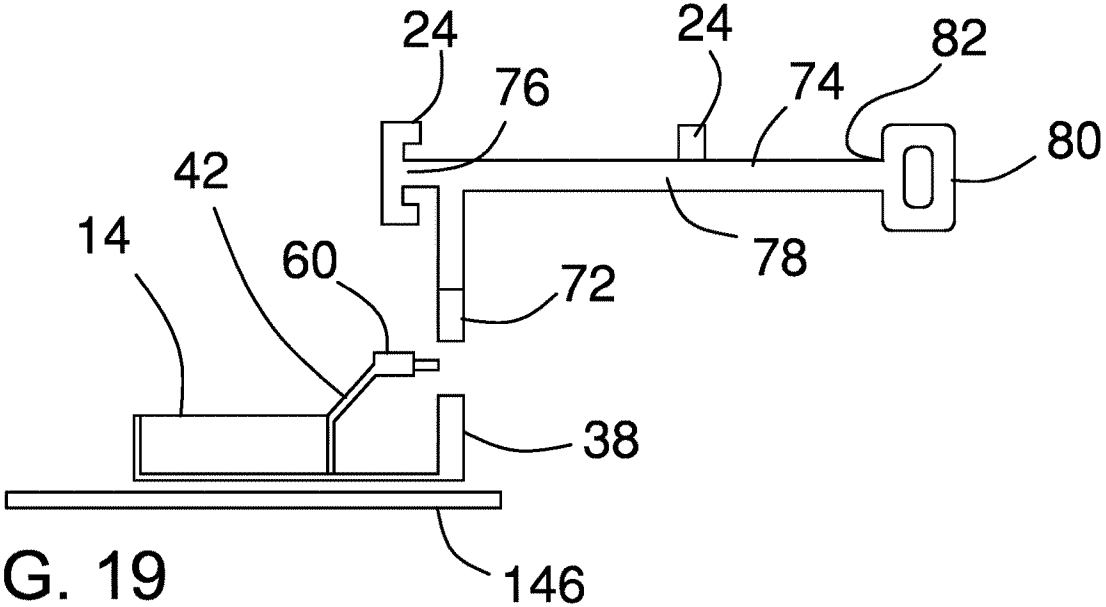
FIG. 19 is a side view of an embodiment of the disclosure.

A bracket 102 is engaged to and extends upwardly from the first base 12 and is positioned proximate to a front 104 of the chair 96. Respective attachment elements 20 are engaged to the bracket 102. A respective tensioner 16 is selectively engageable to and extendable between the bracket 102 and the press frame 44. The extension 72 is selectively engageable to the bracket 102, as shown in FIG. 19, positioning the extension 72 for selective rotational engagement of the pair of swinging arms 74.

A pair of foot arrests 106 is engaged to the first base 12 and brackets the bracket 102. Each foot arrest 106 is configured to abut a respective foot of the user, preventing lateral movement of the respective foot while performing a leg strengthening exercise using the pair of swinging arms 74.

A plurality of second interface elements 108 is selectively engageable to the chair 96. Respective attachment elements 20 of the plurality of attachment elements 20 are engaged to each of the second interface elements 108. Respective attachment elements 20 of the plurality of attachment elements 20 are engaged to opposed sides 110 of the chair 96 so that each attachment element 20 is opposingly positioned relative to another attachment element 20. Respective tensioners 16 thus are engageable to and are extendable between a respective second interface element 108 and the chair 96. The respective tensioners 16 are configured for provide resistance to the user moving the second interface elements 108 relative to the chair 96.

The plurality of second interface elements 108 comprises a butterfly unit 112. The butterfly unit 112 comprises an extender 114, which is selectively engageable to a rear 116 of the chair 96 so that the extender 114 extends upwardly from the rear 116 and is substantially perpendicularly to the first base 12. A pair of swing arms 118 is selectively and rotationally engageable to the extender 114. Each swing arm 118 has an attachment element 20 engaged to a first endpoint 120 and an armrest 122 is engaged to a second endpoint 124. A respective tensioner 16 is selectively engageable to the attachment elements 20 to mutually engage the swing arms 118. Each armrest 122 is configured for positioning of a respective arm of the user seated in the chair 96, positioning the user to perform an upper body strengthening exercise.

The plurality of second interface elements 108 also may comprise a pair of pull handles 144. A pair of attachment elements 20 is engaged singly to the pull handles 144 so that each pull handle 144 is selectively engageable to the chair 96 by engagement of a respective tensioner 16 between the attachment element 20 positioned on the pull handle 144 and a respective attachment element 20 positioned on the chair 96. Each pull handle 144 is configured to be grasped in a respective hand of the user seated in the chair 96, positioning the user to perform an arm strengthening exercise, such as alternating one arm curls, one arm overhead presses, and the like.

The plurality of second interface elements 108 also may comprise a curling rod 126, which has opposing ends 128. Each of a pair of attachment elements 20 is engaged to a respective opposing end 128. The curling rod 126 is selectively engageable to the chair 96 by engagement of the tensioners 16 between the attachment elements 20 positioned on the curling rod 126 and respective attachment elements 20 positioned on the chair 96. The curling rod 126 is configured to be grasped in the hands of the user seated in the chair 96. The user is positioned to perform a curling exercise.

The plurality of second interface elements 108 also may comprise a knee exerciser 130. The knee exerciser 130 comprises a roller rod 132, which has opposed ends 134. Each of a pair of wheels 136 is engaged to a respective opposed end 134 of the roller rod 132. A tube 152 is positioned around the roller rod 132 and extends from proximate to the wheels. A pair of attachment elements 20 is engaged to the tube 152 with the attachment elements 20 being positioned singly proximate to the wheels 136. The tube 152 is selectively engageable to the chair 96 by engagement of respective tensioners 16 between the attachment elements 20 positioned on the tube 152 and respective attachment elements 20 positioned on the chair 96. The tube 152 is configured for positioning of one or both of the feet of the user seated in the chair 96, with the chair 96 being disengaged from the first base 12. The user thus is positioned to perform a knee strengthening exercise.

The plurality of second interface elements 108 also may comprise a back massager 138 selectively hingedly engageable to the rear 116 of the chair 96. The back massager 138 comprises a pair of padded rollers 140, each of which is rotationally engaged to and extends between a pair of opposed side pieces 142 of the back massager 138. A pair of attachment elements 20 is engaged singly to the opposed side pieces 142. The pull handles 144 are selectively engageable to the back massager 138 by engagement of respective tensioners 16 between the attachment elements 20 positioned on the pull handles 144 and respective attachment elements 20 positioned on the back massager 138. Each pull handle 144 is configured to be grasped in a respective hand of the user, positioning the user to extend their arms and to bend at the waist so that the padded rollers 140 roll along a back of the user.

The exercise assembly 10 also may comprise a second base 146, which is configured to be positioned on a substantially horizontal surface. The engagement module 14 and the second step module 84 are selectively engageable to the second base 146. The second base 146 is circumferentially smaller than the first base 12 and can be more readily transported. Respective attachment elements 20 of the plurality of attachment elements 20 are engaged to the second base 146. Respective tensioners 16 are extendable between a respective first interface element 18 and one or more of the second base 146 and the engagement module 14. The respective tensioners 16 are configured to provide resistance to the user moving the first interface elements 18. A pair of footrests 148 is engaged to the second base 146 and are positioned singly proximate to front corners 150 of the second base 146. The footrests 148 are configured for positioning of the feet of the user while exercising.

In use, the first base 12 is positioned on a substantially horizontal surface and the engagement module 14 is engaged to the first base 12. One of the plurality of first interface elements 18 is selected and is engaged to the engagement module 14. One or more tensioners 16 then are extended between the first interface element 18 and one or more of the first base 12 and the engagement module 14. The user then can perform an exercise. Using multiple tensioners 16 increases resistance to the user performing the exercise.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An exercising assembly comprising:

a first base configured for positioning on a substantially horizontal surface;

an engagement module selectively engageable to the first base, such that the engagement module is positioned proximate to a first end of the first base;

a plurality of tensioners;

a plurality of attachment elements engaged to the first base, the engagement module, and the plurality of tensioners, the plurality of attachment elements being selectively mutually couplable to tensioners of the plurality of tensioners;

a plurality of first interface elements selectively engageable to the engagement module, respective attachment elements of the plurality of attachment elements being engaged to each of the first interface elements, such that respective tensioners of the plurality of tensioners are extendable between a respective first interface element of the plurality of first interface elements and one or more of the first base and the engagement module, wherein the respective tensioners are configured for providing resistance to a user moving the respective first interface elements;

wherein the engagement module comprises a lower frame, a respective one of a pair of end members of the lower frame being positioned proximate to the first end of the first base and being rotationally engaged to and extending between a pair of side members of the lower frame, a first connector engaged to the respective one of the pair of end members, an upper frame hingedly engaged to the lower frame, a footpad engaged to the upper frame, and a second connector engaged to the upper frame distal from the lower frame and extending toward the first end of the first base; and respective tensioners of the plurality of tensioners being engaged to and extending between the lower frame and the upper frame, wherein the footpad is configured for positioning of one or both feet of the user, positioning the user for performing a foot exercise or an ankle exercise.

2. The exercising assembly of claim 1, further including:

the plurality of first interface elements comprising a handle selectively engageable to the first connector; and respective attachment elements of the plurality of attachment elements being engaged to the handle, such that the handle is selectively engageable to the first base by engagement of a respective tensioner of the plurality of tensioners between a respective attachment element positioned on the handle and a respective attachment element positioned on the first base, wherein the handle is configured for grasping in one or both hands of the user, positioning the user for selectively performing a pressing exercise and a rowing exercise.

3. The exercising assembly of claim 2, wherein the plurality of first interface elements further comprises:

an adapter selectively engageable to the second connector, such that the adapter is positioned for axial rotation, the handle being selectively engageable to the adapter, wherein the handle is configured for grasping in one or both hands of the user, positioning the user for performing a pulldown exercise;

a lift frame selectively hingedly engageable by a forward element to the adapter, each of a pair of attachment elements of the plurality of attachment elements being engaged to respective opposed side elements of the lift frame and positioned substantially equally distant from the forward element and a rearward element of the lift frame, the rearward element being offset from a plane defined by the forward element and the opposed side elements, the rearward element being padded, wherein the rearward element is configured for engaging one or both of the feet of the user, positioning the user for performing a leg lift exercise; and a pair of rollers engaged to the lift frame and being positioned singly on the opposed side elements proximate to the rearward element, such that one or both of the feet of the user are positionable within the lift frame with one or both heels of the user engaging the rearward element, positioning the user for performing a leg pull exercise.

4. The exercising assembly of claim 3, further including:

the adapter is selectively engageable to the second connector, such that the second connector is operationally engaged to the first connector;

an extension selectively engageable to the adapter;

the plurality of first interface elements further comprises a pair of swinging arms selectively rotationally engageable to the extension, such that the extension is positioned proximate to a first terminus of each swinging arm;

respective attachment elements of the plurality of attachment elements being positioned two apiece on each swinging arm, one attachment element being positioned proximate to the first terminus of each swinging arm, the other attachment element being positioned proximate to a midpoint of each swinging arm, such that the respective attachment elements are opposingly positioned on each swinging arm relative to the extension;

a thigh rest engaged to a second terminus of each swinging arm, such that a respective tensioner of the plurality of tensioners is selectively engageable to the attachment elements positioned proximate to the first termini or to the attachment elements positioned proximate to the midpoints, wherein each thigh rest is configured for positioning of a respective thigh or grasping in a respective hand of the user, positioning the user for performing a leg strengthening exercise or an arm strengthening exercise, respectively; and a pair of foot arrests engaged to the first base and bracketing a bracket, wherein each foot arrest is configured for abutting a respective foot of the user, preventing lateral movement of the respective foot while performing a leg strengthening exercise using the pair of swinging arms.

5. The exercising assembly of claim 1, further including a step module comprising:

a lower framework selectively engageable to the first base;

an axle engaged to and extending between opposed edges of the lower framework;

a pair of foot frameworks, each foot framework being engaged to the axle;

respective attachment elements of the plurality of attachment elements being engaged to each of the foot frameworks, such that each foot framework is selectively engageable to the first base by engagement of a respective tensioner of the plurality of tensioners between the attachment element positioned on the foot framework and a respective attachment element positioned on the first base; and a pair of foot plates, each foot plate being engaged to a respective foot framework, wherein each foot plate is configured for positioning of a respective foot of the user, positioning the user for performing a stepping exercise.

6. The exercising assembly of claim 5, further including:

a chair configured for seating of the user, positioning the user for performing a variety of seated exercises using the step module and respective tensioners or using the engagement module in combination with respective first interface elements and respective tensioners; and a cushion selectively positionable on the chair.

7. The exercising assembly of claim 6, wherein the chair is selectively engageable to the first base such that the chair is positioned proximate to a second end of the first base and faces the first end.

8. The exercising assembly of claim 1, wherein the plurality of tensioners comprise elastic bands.

9. The exercising assembly of claim 1, wherein the plurality of attachment elements comprise one or more of hooks, eyebolts, rings, carabiniers, and clips.

10. The exercising assembly of claim 1, wherein the plurality of first interface elements comprises:

a press frame selectively engageable to the first connector;

a press handle engaged to the press frame distal from the first base;

respective attachment elements of the plurality of attachment elements being engaged to the press frame, such that the press frame is selectively engageable to the first base by engagement of a respective tensioner of the plurality of tensioners between a respective attachment element positioned on the press frame and a respective attachment element positioned on the first base, wherein the press handle is configured for grasping in one or both hands of the user, positioning the user for selectively performing a press exercise and a rowing exercise; and a press plate selectively engageable to the press frame, wherein the press plate is configured for positioning of one or both of the feet of the user, positioning the user for performing a leg press exercise.

11. The exercising assembly of claim 1, wherein the plurality of first interface elements comprises:

a foot rod having opposing termini;

a pair of attachment elements of the plurality of attachment elements engaged to the foot rod and being positioned singly proximate to the opposing termini, such that the pair of attachment elements are selectively engageable to the respective tensioners extending between the lower frame and the upper frame, wherein the foot rod is configured for positioning atop one or both of the feet positioned on the footpad, positioning the user for performing foot and ankle exercises;

an arch rod rotationally engageable to the second connector, wherein the arch rod is configured for rollably engaging an arch of a foot of the user; and a heel plate selectively engageable to the arch rod, wherein the heel plate is configured for positioning of one or both of the feet of the user, positioning the user for performing foot, ankle, and leg exercises.

12. An exercising assembly comprising:

a first base configured for positioning on a substantially horizontal surface;

an engagement module selectively engageable to the first base, such that the engagement module is positioned proximate to a first end of the first base;

a plurality of tensioners;

a plurality of attachment elements engaged to the first base, the engagement module, and the plurality of tensioners, the plurality of attachment elements being selectively mutually couplable to tensioners of the plurality of tensioners;

a plurality of first interface elements selectively engageable to the engagement module, respective attachment elements of the plurality of attachment elements being engaged to each of the first interface elements, such that respective tensioners of the plurality of tensioners are extendable between a respective first interface element of the plurality of first interface elements and one or more of the first base and the engagement module, wherein the respective tensioners are configured for providing resistance to a user moving the respective first interface elements;

a step module comprising a lower framework selectively engageable to the first base, an axle engaged to and extending between opposed edges of the lower framework, a pair of foot frameworks, each foot framework being engaged to the axle, respective attachment elements of the plurality of attachment elements being engaged to each of the foot frameworks, such that each foot framework is selectively engageable to the first base by engagement of a respective tensioner of the plurality of tensioners between the attachment element positioned on the foot framework and a respective attachment element positioned on the first base, and a pair of foot plates, each foot plate being engaged to a respective foot framework, wherein each foot plate is configured for positioning of a respective foot of the user, positioning the user for performing a stepping exercise;

a chair configured for seating of the user, positioning the user for performing a variety of seated exercises using the step module and respective tensioners or using the engagement module in combination with respective first interface elements and respective tensioners;

a cushion selectively positionable on the chair;

a plurality of second interface elements selectively engageable to the chair, respective attachment elements of the plurality of attachment elements being engaged to each of the second interface elements; and respective attachment elements of the plurality of attachment elements being engaged to opposed sides the chair, such that each attachment element is opposingly positioned relative to another attachment element, such that respective tensioners of the plurality of tensioners are extendable between a respective second interface element of the plurality of second interface elements and the chair, wherein the respective tensioners are configured for providing resistance to the user moving the respective second interface element relative to the chair.

13. The exercising assembly of claim 12, wherein the plurality of second interface elements comprises:

a pair of pull handles, a pair of attachment elements of the plurality of attachment elements being engaged singly to the pull handles, such that each pull handle is selectively engageable to the chair by engagement of a respective tensioner of the plurality of tensioners between the attachment element positioned on the pull handle and a respective attachment element positioned on the chair, wherein each pull handle is configured for grasping in a respective hand of the user seated in the chair, positioning the user for performing an arm strengthening exercise; and a curling rod having opposing ends, each of a pair of attachment elements of the plurality of attachment elements being engaged to a respective opposing end, such that the curling rod is selectively engageable to the chair by engagement of respective tensioners of the plurality of tensioners between the attachment elements positioned on the curling rod and respective attachment elements positioned on the chair, wherein the curling rod is configured for grasping in the hands of the user seated in the chair, positioning the user for performing a curling exercise.

14. The exercising assembly of claim 13, wherein the plurality of second interface elements further comprises a back massager selectively hingedly engageable to a rear of the chair, the back massager comprising:

a pair of padded rollers rotationally engaged to and extending between a pair of opposed side pieces;

a pair of attachment elements of the plurality of attachment elements engaged singly to the opposed side pieces, such that the pull handles are selectively engageable to the back massager by engagement of respective tensioners of the plurality of tensioners between the attachment elements positioned on the pull handles and respective attachment elements positioned on the back massager, wherein each pull handle is configured for grasping in a respective hand of the user, positioning the user for extending their arms and bending at the waist, such that the padded rollers roll along a back of the user.

15. The exercising assembly of claim 12, wherein the plurality of second interface elements comprises a butterfly unit comprising:

an extender selectively engageable to a rear of the chair, such that the extender extends upwardly from the rear of the chair and substantially perpendicularly to the first base; and a pair of swing arms selectively rotationally engageable to the extender, each swing arm having an attachment element of the plurality of attachment elements engaged to a first endpoint and an armrest engaged to a second endpoint, such that a respective tensioner of the plurality of tensioners is selectively engageable to the attachment elements for mutually engaging the swing arms, wherein each armrest is configured for positioning of a respective arm of the user seated in the chair, positioning the user for performing an upper body strengthening exercise.

16. The exercising assembly of claim 12, wherein the plurality of second interface elements comprises a knee exerciser comprising:

a roller rod having opposed ends;

a pair of wheels, each wheel being engaged to a respective opposed end of the roller rod;

a tube positioned around the roller rod; and a pair of attachment elements of the plurality of attachment elements being engaged to the tube and being positioned singly proximate to the wheels, such that the tube is selectively engageable to the chair by engagement of respective tensioners of the plurality of tensioners between the attachment elements positioned on the tube and respective attachment elements positioned on the chair, wherein the tube is configured for positioning of one or both feet of the user seated in the chair with the chair being disengaged from the first base, positioning the user for performing a knee strengthening exercise.

17. An exercising assembly comprising:

a first base configured for positioning on a substantially horizontal surface;

an engagement module selectively engageable to the first base, such that the engagement module is positioned proximate to a first end of the first base;

a plurality of tensioners;

a plurality of attachment elements engaged to the first base, the engagement module, and the plurality of tensioners, the plurality of attachment elements being selectively mutually couplable to tensioners of the plurality of tensioners;

a plurality of first interface elements selectively engageable to the engagement module, respective attachment elements of the plurality of attachment elements being engaged to each of the first interface elements, such that respective tensioners of the plurality of tensioners are extendable between a respective first interface element of the plurality of first interface elements and one or more of the first base and the engagement module, wherein the respective tensioners are configured for providing resistance to a user moving the respective first interface elements;

a step module comprising a lower framework selectively engageable to the first base, an axle engaged to and extending between opposed edges of the lower framework, a pair of foot frameworks, each foot framework being engaged to the axle, respective attachment elements of the plurality of attachment elements being engaged to each of the foot frameworks, such that each foot framework is selectively engageable to the first base by engagement of a respective tensioner of the plurality of tensioners between the attachment element positioned on the foot framework and a respective attachment element positioned on the first base, and a pair of foot plates, each foot plate being engaged to a respective foot framework, wherein each foot plate is configured for positioning of a respective foot of the user, positioning the user for performing a stepping exercise;

a chair configured for seating of the user, positioning the user for performing a variety of seated exercises using the step module and respective tensioners or using the engagement module in combination with respective first interface elements and respective tensioners, wherein the chair is selectively engageable to the first base such that the chair is positioned proximate to a second end of the first base and faces the first end;

a cushion selectively positionable on the chair;

a bracket engaged to and extending upwardly from the first base and being positioned proximate to a front of the chair;

respective attachment elements of the plurality of attachment elements being engaged to the bracket, such that a respective tensioner of the plurality of tensioners is selectively engageable to and extendable between the bracket and a press frame; and an extension selectively engageable to an adapter, the extension being selectively engageable to the bracket, positioning the extension for selective rotational engagement of a pair of swinging arms.

18. An exercising assembly comprising:

a first base configured for positioning on a substantially horizontal surface;

an engagement module selectively engageable to the first base, such that the engagement module is positioned proximate to a first end of the first base;

a plurality of tensioners;

a plurality of attachment elements engaged to the first base, the engagement module, and the plurality of tensioners, the plurality of attachment elements being selectively mutually couplable to tensioners of the plurality of tensioners;

a plurality of first interface elements selectively engageable to the engagement module, respective attachment elements of the plurality of attachment elements being engaged to each of the first interface elements, such that respective tensioners of the plurality of tensioners are extendable between a respective first interface element of the plurality of first interface elements and one or more of the first base and the engagement module, wherein the respective tensioners are configured for providing resistance to a user moving the respective first interface elements;

a step module comprising a lower framework selectively engageable to the first base, an axle engaged to and extending between opposed edges of the lower framework, a pair of foot frameworks, each foot framework being engaged to the axle, respective attachment elements of the plurality of attachment elements being engaged to each of the foot frameworks, such that each foot framework is selectively engageable to the first base by engagement of a respective tensioner of the plurality of tensioners between the attachment element positioned on the foot framework and a respective attachment element positioned on the first base, and a pair of foot plates, each foot plate being engaged to a respective foot framework, wherein each foot plate is configured for positioning of a respective foot of the user, positioning the user for performing a stepping exercise;

a second base configured for positioning on a substantially horizontal surface, the engagement module and the step module being selectively engageable to the second base, the second base being circumferentially smaller than the first base;

respective attachment elements of the plurality of attachment elements being engaged to the second base, such that respective tensioners of the plurality of tensioners are extendable between a respective first interface element of the plurality of first interface elements and one or more of the second base and the engagement module, wherein the respective tensioners are configured for providing resistance to the user moving the respective first interface element; and a pair of footrests engaged to the second base, such that the footrests are positioned singly proximate to front corners of the second base, wherein the footrests are configured for positioning of the feet of the user while exercising.

19. An exercising assembly comprising:

a first base configured for positioning on a substantially horizontal surface;

an engagement module selectively engageable to the first base, such that the engagement module is positioned proximate to a first end of the first base, the engagement module comprising:

a lower frame, a respective one of a pair of end members of the lower frame being positioned proximate to the first end of the base and being rotationally engaged to and extending between a pair of side members of the lower frame, a first connector engaged to the respective one of the pair of end members, an upper frame hingedly engaged to the lower frame, a footpad engaged to the upper frame, and a second connector engaged to the upper frame distal from the lower frame and extending toward the first end of the first base;

a plurality of tensioners, the tensioners comprising elastic bands;

a plurality of attachment elements engaged to the first base, the engagement module, and the plurality of tensioners, the plurality of attachment elements being selectively mutually couplable to tensioners of the plurality of tensioners, such that respective tensioners of the plurality of tensioners are extendable between the lower frame and the upper frame, wherein the footpad is configured for positioning of one or both feet of a user, positioning the user for performing a foot exercise or an ankle exercise, the attachment elements of the plurality of attachment elements comprising one or more of hooks, eyebolts, rings, carabiniers, and clips;

a plurality of first interface elements selectively engageable to the engagement module, respective attachment elements of the plurality of attachment elements being engaged to each of the first interface elements, such that respective tensioners of the plurality of tensioners are extendable between a respective first interface element of the plurality of first interface elements and one or more of the first base and the engagement module, wherein the respective tensioners are configured for providing resistance to the user while exercising, the plurality of first interface elements comprising:

a press frame selectively engageable to the first connector, a press handle being engaged to the press frame distal from the first base, respective attachment elements of the plurality of attachment elements being engaged to the press frame, such that the press frame is selectively engageable to the first base by engagement of a respective tensioner of the plurality of tensioners between a respective attachment element positioned on the press frame and a respective attachment element positioned on the first base, wherein the press handle is configured for grasping in one or both hands of the user, positioning the user for selectively performing a press exercise and a rowing exercise, a press plate selectively engageable to the press frame, wherein the press plate is configured for positioning of one or both of the feet of the user, positioning the user for performing a leg press exercise, a foot rod having opposing termini, a pair of attachment elements of the plurality of attachment elements being engaged to the foot rod and being positioned singly proximate to the opposing termini, such that the attachment elements are selectively engageable to the respective tensioners extending between the lower frame and the upper frame, wherein the foot rod is configured for positioning atop one or both of the feet positioned on the footpad, positioning the user for performing foot and ankle exercises, an arch rod rotationally engageable to the second connector, wherein the arch rod is configured for rollably engaging an arch of a foot of the user, a heel plate selectively engageable to the arch rod, wherein the heel plate is configured for positioning of one or both of the feet of the user, positioning the user for performing foot, ankle, and leg exercises, a handle selectively engageable to the first connector, respective attachment elements of the plurality of attachment elements being engaged to the handle, such that the handle is selectively engageable to the first base by engagement of a respective tensioner of the plurality of tensioners between a respective attachment element positioned on the handle and a respective attachment element positioned on the first base, wherein the handle is configured for grasping in one or both hands of the user, positioning the user for selectively performing a pressing exercise and a rowing exercise, an adapter selectively engageable to the second connector, such that the adapter is positioned for axial rotation, the handle being selectively engageable to the adapter, wherein the handle is configured for grasping in one or both hands of the user, positioning the user for performing a pulldown exercise, a lift frame selectively hingedly engageable by a forward element to the adapter, each of a pair of attachment elements of the plurality of attachment elements being engaged to respective opposed side elements of the lift frame and positioned substantially equally distant from the forward element and a rearward element of the lift frame, the rearward element being offset from a plane defined by the forward element and the opposed side elements, the rearward element being padded, wherein the rearward element is configured for engaging one or both of the feet of the user, positioning the user for performing a leg lift exercise, a pair of rollers engaged to the lift frame and being positioned singly on the opposed side elements proximate to the rearward element, such that one or both of the feet of the user are positionable within the lift frame with one or both heels of the user engaging the rearward element, positioning the user for performing a leg pull exercise, the adapter being selectively engageable to the second connector, such that the second connector is operationally engaged to the first connector, an extension selectively engageable to the adapter, a pair of swinging arms selectively rotationally engageable to the extension, such that the extension is positioned proximate to a first terminus of each swinging arm, respective attachment elements of the plurality of attachment elements being positioned two apiece on each swinging arm, one attachment element being positioned proximate to the first terminus of each swinging arm, the other attachment element being positioned proximate to a midpoint of each swinging arm, such that the respective attachment elements are opposingly positioned on each swinging arm relative to the extension, a thigh rest being engaged to a second terminus of each swinging arm, such that a respective tensioner of the plurality of tensioners is selectively engageable to the attachment elements positioned proximate to the first termini or to the attachment elements positioned proximate to the midpoints, wherein each thigh rest is configured for positioning of a respective thigh or grasping in a respective hand of the user, positioning the user for performing a leg strengthening exercise or an arm strengthening exercise, respectively;

a step module comprising:

a lower framework selectively engageable to the first base, an axle engaged to and extending between opposed edges of the lower framework, a pair of foot frameworks, each foot framework being engaged to the axle, respective attachment elements of the plurality of attachment elements being engaged to each of the foot frameworks, such that each foot framework is selectively engageable to the first base by engagement of a respective tensioner of the plurality of tensioners between the attachment element positioned on the foot framework and a respective attachment element positioned on the first base, and a pair of foot plates, each foot plate being engaged to a respective foot framework, wherein each foot plate is configured for positioning of a respective foot of the user, positioning the user for performing a stepping exercise;

a chair configured for seating of the user, positioning the user for performing a variety of seated exercises using the step module and respective tensioners or using the engagement module in combination with respective first interface elements and respective tensioners, the chair being selectively engageable to the first base such that the chair is positioned proximate to a second end of the first base and faces the first end;

a bracket engaged to and extending upwardly from the first base and being positioned proximate to a front of the chair, respective attachment elements of the plurality of attachment elements being engaged to the bracket, such that a respective tensioner of the plurality of tensioners is selectively engageable to and extendable between the bracket and the press frame, the extension being selectively engageable to the bracket, positioning the extension for selective rotational engagement of the pair of swinging arms;

a pair of foot arrests engaged to the first base and bracketing the bracket, wherein each foot arrest is configured for abutting a respective foot of the user, preventing lateral movement of the respective foot while performing a leg strengthening exercise using the pair of swinging arms;

a cushion selectively positionable on the chair;

a plurality of second interface elements selectively engageable to the chair, respective attachment elements of the plurality of attachment elements being engaged to each of the second interface elements, respective attachment elements of the plurality of attachment elements being engaged to opposed sides the chair, such that each attachment element is opposingly positioned relative to another attachment element, such that respective tensioners of the plurality of tensioners are extendable between a respective second interface element of the plurality of second interface elements and the chair, wherein the respective tensioners are configured for providing resistance to the user moving the respective second interface element relative to the chair, the plurality of second interface elements comprising:

a butterfly unit comprising:

an extender selectively engageable to a rear of the chair, such that the extender extends upwardly from the rear of the chair and substantially perpendicularly to the first base, and a pair of swing arms selectively rotationally engageable to the extender, each swing arm having an attachment element of the plurality of attachment elements engaged to a first endpoint and an armrest engaged to a second endpoint, such that a respective tensioner of the plurality of tensioners is selectively engageable to the attachment elements for mutually engaging the swing arms, wherein each armrest is configured for positioning of a respective arm of the user seated in the chair, positioning the user for performing an upper body strengthening exercise;

a pair of pull handles, a pair of attachment elements of the plurality of attachment elements being engaged singly to the pull handles, such that each pull handle is selectively engageable to the chair by engagement of a respective tensioner of the plurality of tensioners between the attachment element positioned on the pull handle and a respective attachment element positioned on the chair, wherein each pull handle is configured for grasping in a respective hand of the user seated in the chair, positioning the user for performing an arm strengthening exercise, a curling rod having opposing ends, each of a pair of attachment elements of the plurality of attachment elements being engaged to a respective opposing end, such that the curling rod is selectively engageable to the chair by engagement of respective tensioners of the plurality of tensioners between the attachment elements positioned on the curling rod and respective attachment elements positioned on the chair, wherein the curling rod is configured for grasping in the hands of the user seated in the chair, positioning the user for performing a curling exercise, a knee exerciser comprising:

a roller rod having opposed ends, a pair of wheels, each wheel being engaged to a respective opposed end of the roller rod, and a tube positioned around the roller rod, a pair of attachment elements of the plurality of attachment elements being engaged to the tube and being positioned singly proximate to the wheels, such that the tube is selectively engageable to the chair by engagement of respective tensioners of the plurality of tensioners between the attachment elements positioned on the tube and respective attachment elements positioned on the chair, wherein the tube is configured for positioning of one or both of the feet of the user seated in the chair with the chair being disengaged from the first base, positioning the user for performing a knee strengthening exercise, a back massager selectively hingedly engageable to the rear of the chair, the back massager comprising:

a pair of padded rollers rotationally engaged to and extending between a pair of opposed side pieces;

a pair of attachment elements of the plurality of attachment elements engaged singly to the opposed side pieces, such that the pull handles are selectively engageable to the back massager by engagement of respective tensioners of the plurality of tensioners between the attachment elements positioned on the pull handles and respective attachment elements positioned on the back massager, wherein each pull handle is configured for grasping in a respective hand of the user, positioning the user for extending their arms and bending at the waist, such that the padded rollers roll along a back of the user;

a second base configured for positioning on a substantially horizontal surface, the engagement module and the step module being selectively engageable to the second base, the second base being circumferentially smaller than the first base;

respective attachment elements of the plurality of attachment elements being engaged to the second base, such that respective tensioners of the plurality of tensioners are extendable between a respective first interface element of the plurality of first interface elements and one or more of the second base and the engagement module, wherein the respective tensioners are configured for providing resistance to the user moving the respective first interface element; and a pair of footrests engaged to the second base, such that the footrests are positioned singly proximate to front corners of the second base, wherein the footrests are configured for positioning of the feet of the user while exercising.

* * * * *